US007654662B2

(12) United States Patent
Nakazawa et al.

(10) Patent No.: US 7,654,662 B2
(45) Date of Patent: Feb. 2, 2010

(54) INK JET PRINTING METHOD AND INK JET PRINTING APPARATUS

(75) Inventors: Koichiro Nakazawa, Tokyo (JP); Takuei Ishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 11/281,395

(22) Filed: Nov. 18, 2005

(65) Prior Publication Data

US 2006/0109326 A1 May 25, 2006

(30) Foreign Application Priority Data

Nov. 19, 2004 (JP) ..... 2004-336366

(51) Int. Cl.
*B41J 2/01* (2006.01)

(52) U.S. Cl. ..... 347/101; 106/31.37; 106/31.75; 347/100; 347/102; 347/43; 347/85; 347/96; 428/195.1; 428/408; 523/160

(58) Field of Classification Search ..... 06/31.37, 06/31.75; 347/100–102, 43, 85, 96; 428/195.1, 428/408; 523/160
See application file for complete search history.

(56) References Cited

U.S. PATENT DOCUMENTS 5,428,383 A 6/1995 Shields et al. ..... 347/96
5,488,402 A 1/1996 Shields et al. ..... 347/96
5,518,534 A 5/1996 Pearlstine et al. ..... 106/20 R
5,618,338 A * 4/1997 Kurabayashi et al. .... 106/31.37
5,635,969 A * 6/1997 Allen ..... 347/96
5,976,230 A 11/1999 Askeland et al. ..... 106/31.27
6,084,006 A 7/2000 Kashiwazaki et al. ..... 523/160
6,086,197 A * 7/2000 Kubota et al. ..... 347/96
6,162,510 A 12/2000 Kashiwazaki et al. ..... 427/511
6,178,009 B1 1/2001 Yamada et al. ..... 358/1.9
6,203,604 B1 3/2001 Kashiwazaki et al. ..... 106/31.5
6,238,045 B1 * 5/2001 Ono et al. ..... 347/96
6,248,482 B1 6/2001 Kashiwazaki et al. ..... 430/7
6,264,320 B1 * 7/2001 Moriyama et al. ..... 347/101
6,309,062 B1 10/2001 Hickman et al. ..... 347/96
6,412,934 B1 7/2002 Moriyama et al. ..... 347/96
6,460,989 B1 * 10/2002 Yano et al. ..... 347/101
6,550,904 B2 * 4/2003 Koitabashi et al. ..... 347/100

(Continued)

FOREIGN PATENT DOCUMENTS

CN 1072114 10/2001

(Continued)

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

An ink jet printing method and apparatus are provided which, even when an ink containing a colorant with a coagulating property is applied to a glossy print medium; enable to keep the glossiness of the print medium from being degraded. For this purpose, when forming an image on a glossy print medium, a coagulation inhibiting liquid for inhibiting a coagulation of ink is applied to at least a part of an area on the print medium where the ink is applied. This suppresses the coagulation of ink on the print medium surface and assures a quick spreading and soaking of ink. As a result, the surface of the glossy print medium can be kept smooth, retaining its glossiness.

6 Claims, 20 Drawing Sheets

U.S. PATENT DOCUMENTS

| | | | | |
|---|---|---|---|---|
| 6,659,601 | B2 | 12/2003 | Goto et al. | 347/100 |
| 6,715,866 | B2 * | 4/2004 | Kasperchik et al. | 347/98 |
| 6,729,718 | B2 | 5/2004 | Goto et al. | 347/100 |
| 6,833,158 | B2 | 12/2004 | Suzuki et al. | 427/149 |
| 6,871,945 | B2 * | 3/2005 | Smith et al. | 347/96 |
| 7,008,671 | B2 | 3/2006 | Ishikawa et al. | 427/152 |
| 7,090,719 | B2 | 8/2006 | Ishikawa et al. | 106/31.49 |
| 7,198,837 | B1 * | 4/2007 | Endo et al. | 428/195.1 |
| 7,273,264 | B2 * | 9/2007 | Nagashima | 347/43 |
| 2003/0069329 | A1 * | 4/2003 | Kubota et al. | 523/160 |
| 2003/0218656 | A1 * | 11/2003 | Yamazaki et al. | 347/43 |
| 2004/0141036 | A1 | 7/2004 | Ishikawa | 347/97 |
| 2004/0176498 | A1 * | 9/2004 | Ando et al. | 523/160 |
| 2004/0212667 | A1 * | 10/2004 | Nishiguchi | 347/96 |
| 2005/0191446 | A1 | 9/2005 | Ishikawa et al. | 428/32.34 |
| 2005/0259137 | A1 * | 11/2005 | Moffatt | 347/85 |
| 2006/0075584 | A1 | 4/2006 | Ishikawa et al. | 8/478 |
| 2006/0077243 | A1 * | 4/2006 | Edwards | 347/102 |
| 2006/0137570 | A1 | 6/2006 | Osumi et al. | 106/31.27 |
| 2006/0191440 | A1 | 8/2006 | Ishikawa et al. | 106/31.46 |
| 2006/0194056 | A1 | 8/2006 | Nagashima et al. | 428/403 |
| 2006/0194897 | A1 | 8/2006 | Kawabe et al. | 523/160 |
| 2006/0222851 | A1 * | 10/2006 | Miyabayashi et al. | 428/408 |

FOREIGN PATENT DOCUMENTS

| | | |
|---|---|---|
| JP | 56-89595 | 7/1981 |
| JP | 63-29971 | 2/1988 |
| JP | 64-9279 | 1/1989 |
| JP | 64-63185 | 3/1989 |
| JP | 5-202328 | 8/1993 |
| JP | 6-106841 | 4/1994 |
| JP | 9-11850 | 1/1997 |
| JP | 9-118850 | 5/1997 |
| JP | 11-227229 | 8/1999 |
| JP | 11-334101 | 12/1999 |
| JP | 11-343441 | 12/1999 |

* cited by examiner

1 μS AFTER

2 μS AFTER

INK JET PRINTING METHOD AND INK JET PRINTING APPARATUS

BACKGROUND OF THE INVENTION

1. Field of the Invention

The present invention relates to an ink jet printing apparatus which forms an image by applying to a print medium an ink containing a colorant that coagulates under a predetermined condition. More specifically, the present invention relates to a construction that prevents problems caused by a coagulation of the colorant on a print medium.

2. Description of the Related Art

As office equipment such as computers, word processors and copying machines advance, a growing number of printing apparatus for outputting information from these equipment has become available on the market. The printing apparatus employing an ink jet printing system in particular has an advantage of being able to reduce the size of a print head easily, print an image at high resolution and high speed and print on plain paper without requiring special processing on the paper. Other advantages include low running cost, low noise and a relative ease with which a full color printing can be realized using multiple color inks. It has therefore found a wide range of applications, including personal users.

Such a widespread use can lead to the user making new demands on the ink jet printing apparatus. In recent years in particular, there are growing calls for increased image fastness such as waterfastness and lightfastness while maintaining a high color saturation. One method of enhancing the image fastness is to make some improvements on the print medium as dedicated paper. However, to stably maintain a high image fastness of various kinds of print mediums including plain paper, it is more effective to provide an ink itself with some features to achieve the above objective. For this reason, recent years have seen many novel inks developed and their applications proposed.

For example, Japanese Patent Application Laid-open No. 11-227229 (1999) discloses, in addition to the conventionally used dye inks, the development of inks containing pigments as colorants and a variety of printing methods using such inks. The inks containing pigments tend to stay on the surface of a print medium with the colorants in a coagulated state, when compared with inks containing dyes as colorants. Thus, the pigment colorants have features of a high color saturation which is not easily faded by sunlight and ozone. To take advantage of both the superiority of the pigment ink and the superiority of the dye ink, the above-cited reference discloses a method that selectively uses these different kinds of inks according to the kind of print medium used and the kind of image to be output. For example, the above document describes that a pigment-based black ink with low penetrability and dye-based color inks with high penetrability are prepared and that a black image may be printed with the black ink or with a combination of different color inks, depending on the kind of print medium and the kind of image to be printed. The cited reference also describes printing color inks first, followed by a black ink overlapping the first printed color inks.

Other methods for enhancing the color saturation and the image fastness propose using a reaction liquid that reacts with color inks containing colorants to make the colorants insoluble or coagulate. For example, Japanese Patent Application Laid-open No. 56-89595 (1981) discloses a method which applies a polymer solution, such as carboxymethyl cellulose, polyvinyl alcohol and polyvinyl acetate, to the print medium before printing and then prints coloring inks. Japanese Patent Application Laid-open No. 63-29971 (1988) discloses a method that involves applying to a print medium a liquid containing an organic compound having two or more cationic groups in one molecule and then printing coloring inks containing anionic dye. Japanese Patent Application Laid-open No. 64-009279 (1989) discloses a method that first applies an acidic liquid containing succinic acid to a print medium and then prints coloring inks. Japanese Patent Application Laid-open No. 64-063185 (1989) describes a method that applies to a print medium a liquid that makes a dye insoluble, before printing coloring inks containing the dye. Japanese Patent Application Laid-open No. 5-202328 (1993) describes a method which applies a reaction liquid containing polyvalent metal ion before printing coloring inks.

Further, Japanese Patent Application Laid-Open Nos. 6-106841 (1994), 9-118850 (1997), 11-334101(1999), and 11-343441(1999), and U.S. Pat. Nos. 5,428,383, 5,488,402 and 5,976,230 disclose a set of a black ink and color inks in which at least one of the color inks exhibits a mutual reactivity with the black ink, with other inks showing no reactivity with the black ink.

All these methods listed above that use a reaction liquid are characterized in that the reaction liquid chemically reacts with the coloring inks containing colorants to coagulate the coloring inks. That is, many ink jet printing apparatus of recent years, whether they use pigments or dyes or whether they require a reaction liquid to induce coagulation, have the colorants coagulate, remain and settle on the surface of a print medium, thereby realizing a satisfactory color saturation and image fastness.

However, the coagulation of colorants described above is not always desirable. For example, when an ink containing a colorant with a coagulating property is applied to glossy paper, a new problem arises. The ink with a coagulating nature tends to stay on the surface of the print medium and form relatively large undulations. Such large undulations on the print medium surface degrade the glossiness of the print medium. Not only can the printed paper in such a state not take advantage of the characteristic of the glossy paper, but a difference in glossiness between the printed portions and the non-printed portions becomes conspicuous, giving the user an impression of unnaturalness.

SUMMARY OF THE INVENTION

The present invention has been accomplished to solve the above problems and its objective is to produce a satisfactory image on a print medium in a way that keeps the print medium from losing its glossiness even when an ink with a coagulating property is used.

A first aspect of the present invention is an ink jet printing method for printing an image on a print medium by ejecting an ink containing a colorant from nozzles, comprising: a step of applying to the print medium a coagulation inhibiting liquid for inhibiting a coagulation of the colorant contained in the ink; and a step of ejecting the ink to the print medium; wherein the coagulation inhibiting liquid is applied to at least a part of an area on the print medium where the ink is applied.

A second aspect of the present invention is an ink jet printing method for printing an image on a print medium by ejecting an ink containing a colorant to the print medium, comprising: a step of determining a kind of print medium used for printing; a step of, if the print medium is found to be a glossy print medium, printing on the glossy print medium by using the ink and the coagulation inhibiting liquid for inhibiting a coagulation of the colorant contained in the ink; and a step of, if the print medium is found to be a non-glossy print medium, printing on the non-glossy print medium by not using the coagulation inhibiting liquid but by using the ink; wherein in the step of printing on the glossy print medium, the coagulation inhibiting liquid is applied to at least a part of an area on the print medium where the ink is applied.

A third aspect of the present invention is an ink jet printing method for printing an image on a print medium by ejecting an ink containing a colorant from nozzles, comprising: a step of ejecting the ink; a step of applying a reaction liquid for accelerating a coagulation of the colorant contained in the ink; and a step of applying a coagulation inhibiting liquid for inhibiting a coagulation of the colorant caused by the ink and the reaction liquid; wherein, if an image is formed on a sheet of print medium, at least one of the reaction liquid application step and the coagulation inhibiting liquid application step is performed in addition to the ink ejection step.

A fourth aspect of the present invention is an ink jet printing method for printing an image on a print medium by ejecting an ink containing a colorant to the print medium, comprising: a step of determining a kind of print medium used for printing; a step of, if the print medium is found to be a glossy print medium, printing on the glossy print medium by using the ink and the coagulation inhibiting liquid for inhibiting a coagulation of the colorant contained in the ink; and a step of, if the print medium is found to be a non-glossy print medium, printing on the non-glossy print medium by using the ink and a reaction liquid for coagulating the colorant contained in the ink; wherein in the step of printing on the glossy print medium, the coagulation inhibiting liquid is applied to at least a part of an area on the print medium where the ink is applied, and in the step of printing on the non-glossy print medium, the reaction liquid is applied to at least a part of the area on the print medium where the ink is applied.

A fifth aspect of the present invention is an ink jet printing apparatus for printing an image on a print medium by ejecting an ink containing a colorant from nozzles, comprising apply unit that applies, to at least a part of an area on the print medium where the ink is applied, a coagulation inhibiting liquid for inhibiting a coagulation of the colorant contained in the ink.

A sixth aspect of the present invention is an ink jet printing apparatus comprising: a first print head for ejecting an ink containing a colorant; a second print head for ejecting a reaction liquid for accelerating a coagulation of the colorant contained in the ink; and a third print head for ejecting a coagulation inhibiting liquid for inhibiting a coagulation of the colorant caused by the ink and the reaction liquid.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of this invention will be described in detail as follows.

This embodiment is characterized in that, when forming an image on a glossy print medium, a coagulation inhibiting liquid for inhibiting a coagulation of a colorant contained in ink is applied to those areas on the print medium where the ink containing the colorant is applied. In this specification, the "glossy print medium" is defined to be one that has an image clarity of 30% or more for a 2-mm optical comb, the image clarity being a measure adopted by JIS H8686 "Test methods for image clarify of anodic oxide coatings on aluminum and aluminum alloys" and JIS K7105 "Testing methods for optical properties of plastics."

Figure 1:
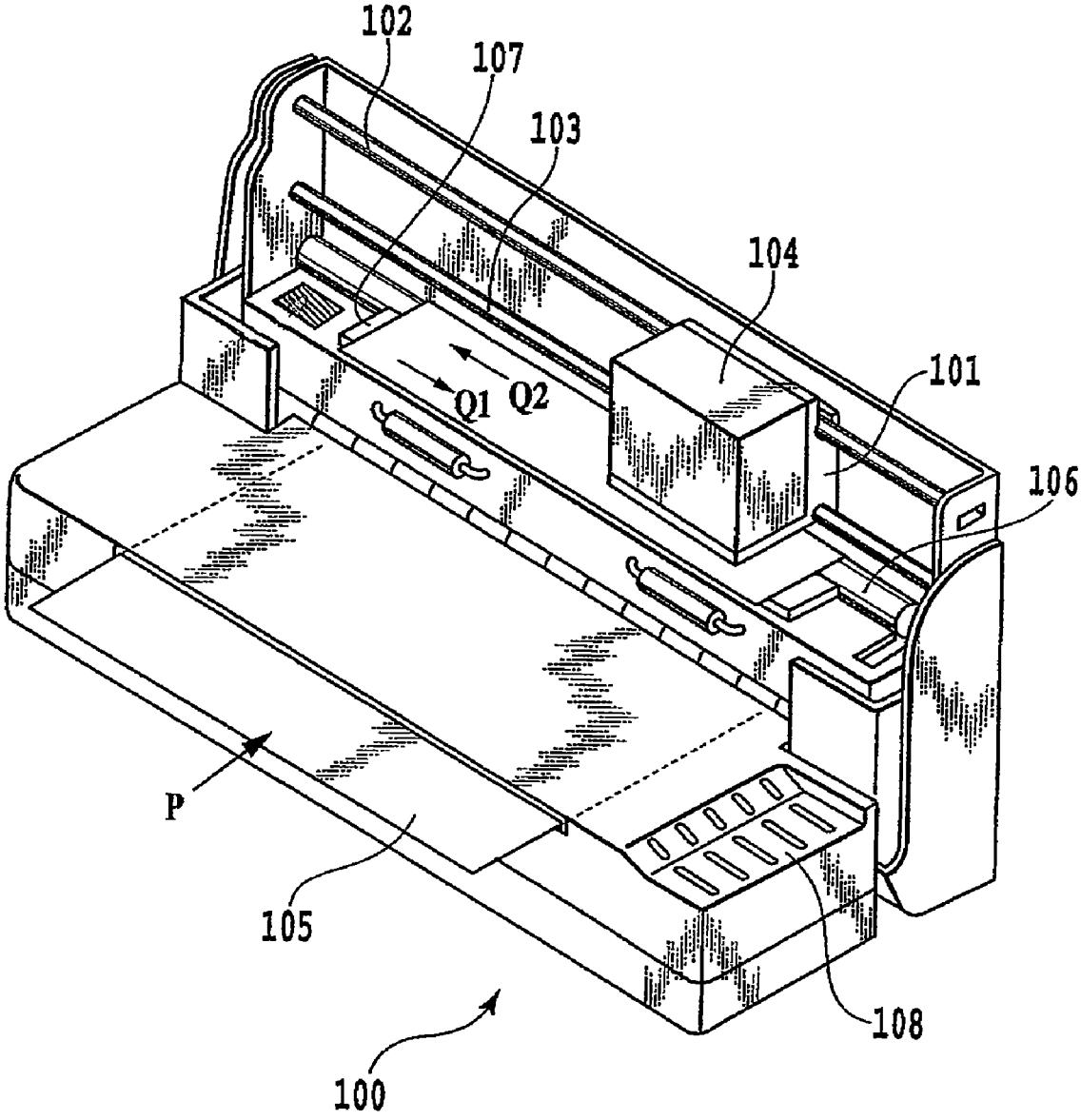
FIG. 1 is a perspective view of a serial type ink jet printing apparatus applicable to this invention.

FIG. 1 is a perspective view of a serial type ink jet printing apparatus applicable to this invention. A print medium 105 inserted at a paper feed position in the ink jet printing apparatus 100 is fed by a transport roller 106 in a direction of arrow P to a printable area of a print head 104. Under the print medium 105 in the printable area is provided a platen 107 which supports the print medium 105 from below in an area where the print head 104 executes the printing operation. It is noted, however, that a hole is formed at a position directly below the printing unit. In the hole is installed an ink absorber which absorbs ink ejected outside edges of the print medium during the "marginless printing". Details of the printing unit will be described later.

Figure 16:
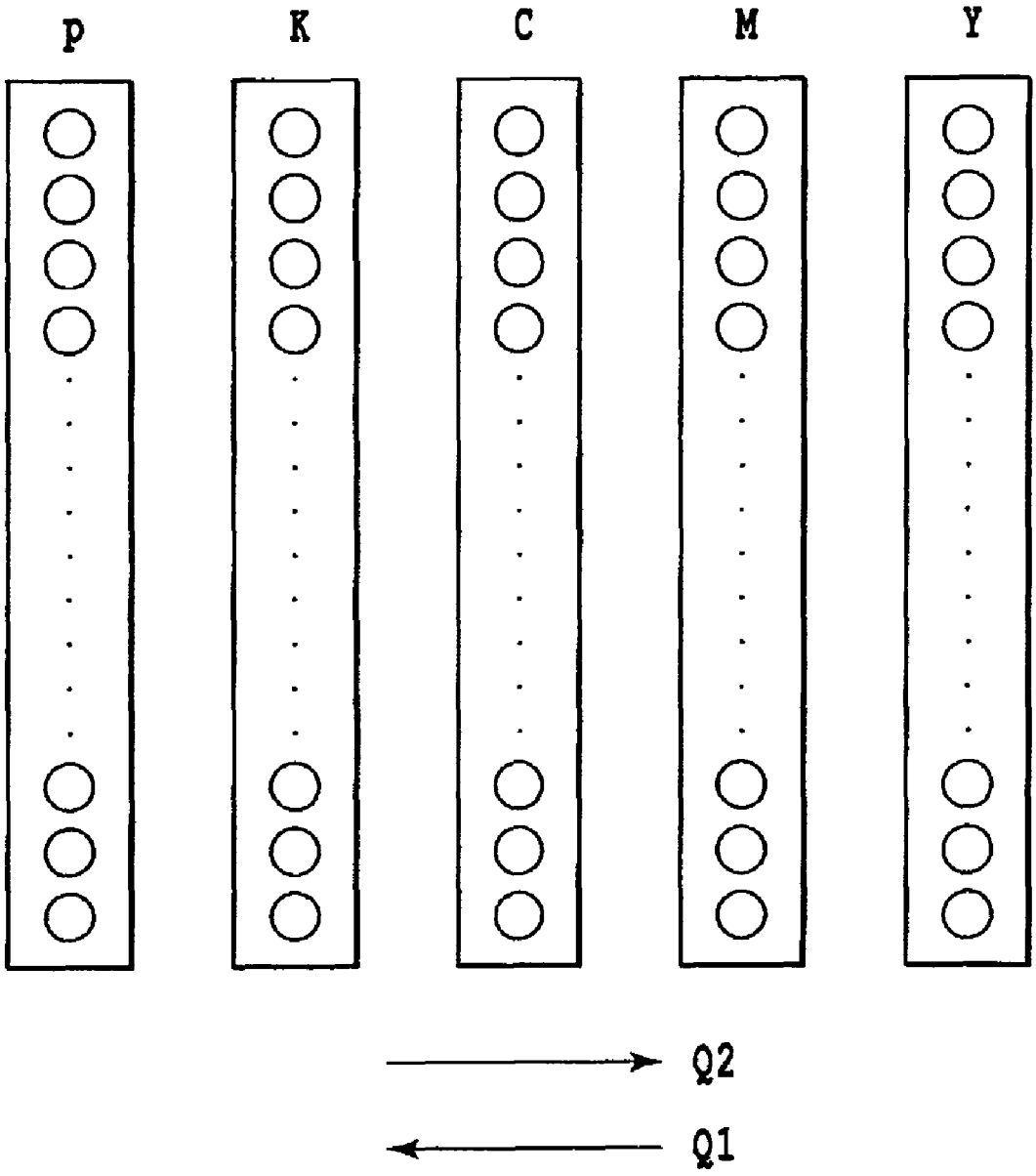
FIG. 16 illustrates an array of ink ejection nozzles of print heads used in a first embodiment of this invention.

A carriage 101 is movable along two guide shafts 102, 103 and reciprocally scans over the printing area in a main scan direction Q1, Q2. The print head 104 mounted on the carriage 101 has a plurality of nozzle groups capable of ejecting a plurality of color inks (KCMY) and a nozzle group to eject a coagulation inhibiting liquid (P) that inhibits colorants contained in the inks from coagulating such as shown in FIG. 16. These nozzle groups (PKCMY) are arranged side by side in a scan direction of the carriage 101. The operation repetitively alternates a main scan, by which while the carriage 101 travels in Q1 or Q2 direction, the print head ejects inks and coagulation inhibiting liquid to form an image on the print medium, and a sub scan by which the print medium 105 is fed a predetermined distance. With this process, an image is successively formed on the print medium. Denoted 108 is a switch unit and a display unit. The switch unit is used to turn on or off the power of the printing apparatus and to set a variety of print modes. The display unit displays a status of the printing apparatus.

Figure 2:
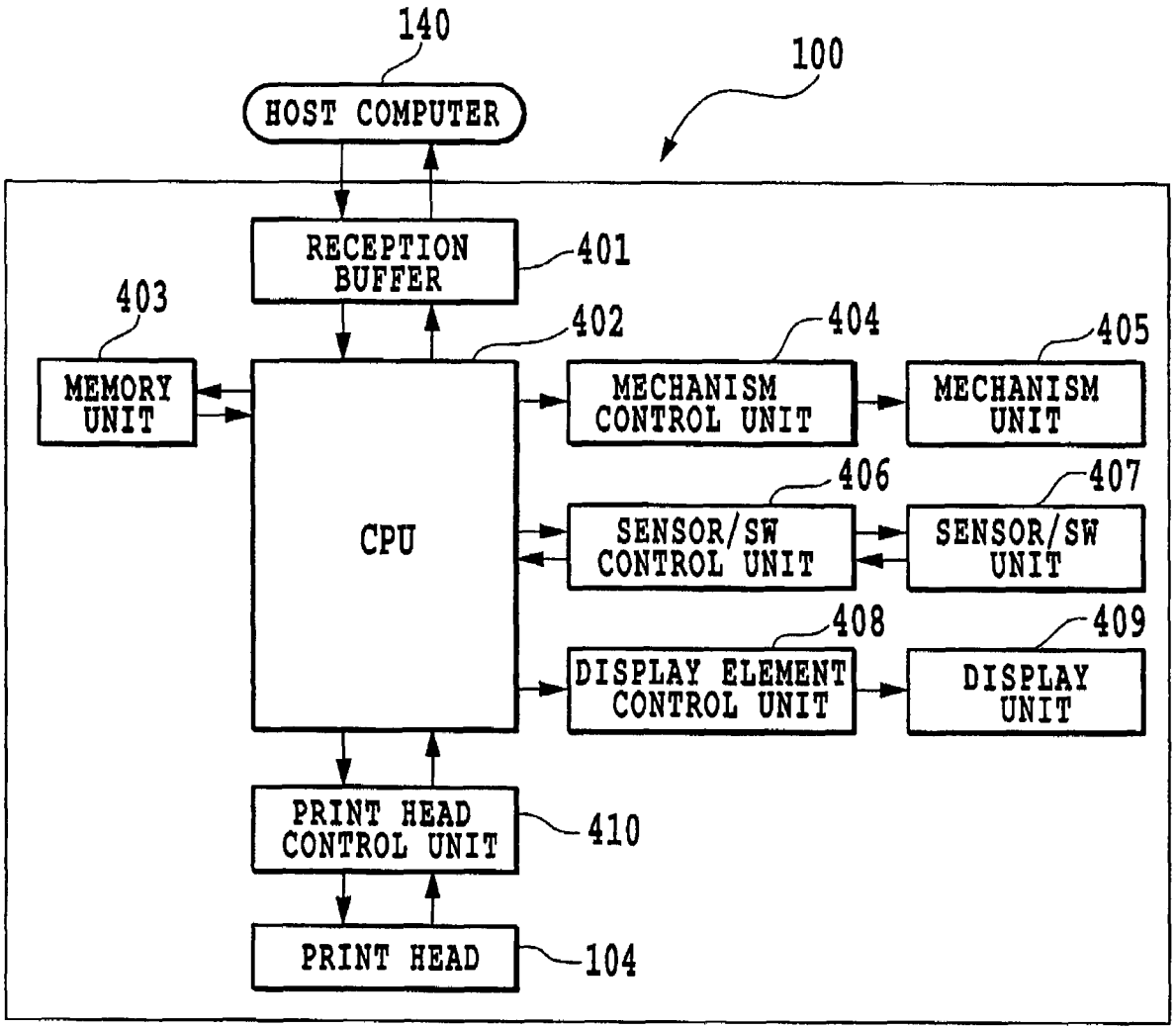
FIG. 2 is a block diagram showing a configuration of a control system for the ink jet printing apparatus applicable to this invention.

FIG. 2 is a block diagram showing a configuration of a control system in the ink jet printing apparatus 100 of FIG. 1. In the figure, a host computer 140 is connected to the printing apparatus 100 and generates image data to be transferred to the printing apparatus. Programs running on an operating system of the host computer 140 include applications and a printer driver. The applications execute processing to generate image data to be used in the printing apparatus. This image data or data before being edited can be taken into the computer through a variety of media. The data thus taken in is displayed on a monitor of the host computer 140 where it is edited and processed by the applications to generate image data R, G, B of sRGB standard, for example. According to a request for printing, this image data is transferred to the printer driver. The printer driver converts the received RGB image data into color-separated data corresponding to combinations of inks—cyan, magenta, yellow and black—that reproduce colors represented by this data. Then, the CMYK color-separated data are each subjected to γ-correction processing and half-toning processing to produce CMYK multivalued image data which is then transferred to the printing apparatus 100.

A receiving buffer 401 in the printing apparatus 100 receives the CMYK multivalued image data from the host computer 140 and transfers them to a CPU 402. Information as to whether data has been received correctly or not and information representing the operating state of the printing apparatus 100 are also notified to the host computer 140 via the receiving buffer 401. The CPU 402 controls various parts in the printing apparatus. The CMYK multivalued image data received by the receiving buffer 401 is converted under the control of the CPU 402 into CMYK binary image data which is transferred to a memory unit 403 where it is stored temporarily. In a case where the coagulation inhibiting liquid (P) is used, binary data for coagulation inhibiting liquid is generated from a logical OR of the CMYK binary image data and stored in the memory unit 403. The memory unit 403 also stores a control program that controls the printing operation and recovery operation performed in the ink jet printing apparatus. A mechanism control unit 404 controls a mechanism unit 405 such as carriage motor and transport motor according to an instruction from the CPU 402. A sensor/SW control unit 406 transfers a signal from a sensor/SW unit 407 made up of various sensors and switches to the CPU 402. A display element control unit 408 controls a display unit 409 made up of LEDs and liquid crystal display elements on display panel group according to an instruction from the CPU 402. A print head control unit 410 controls the print head 104 according to an instruction from the CPU 402 so as to eject liquids according to the binary ejection data of CMYKP. The print head control unit 410 also detects temperature information and others representing the state of the print head 104 and transfers them to the CPU 402.

Figure 3:
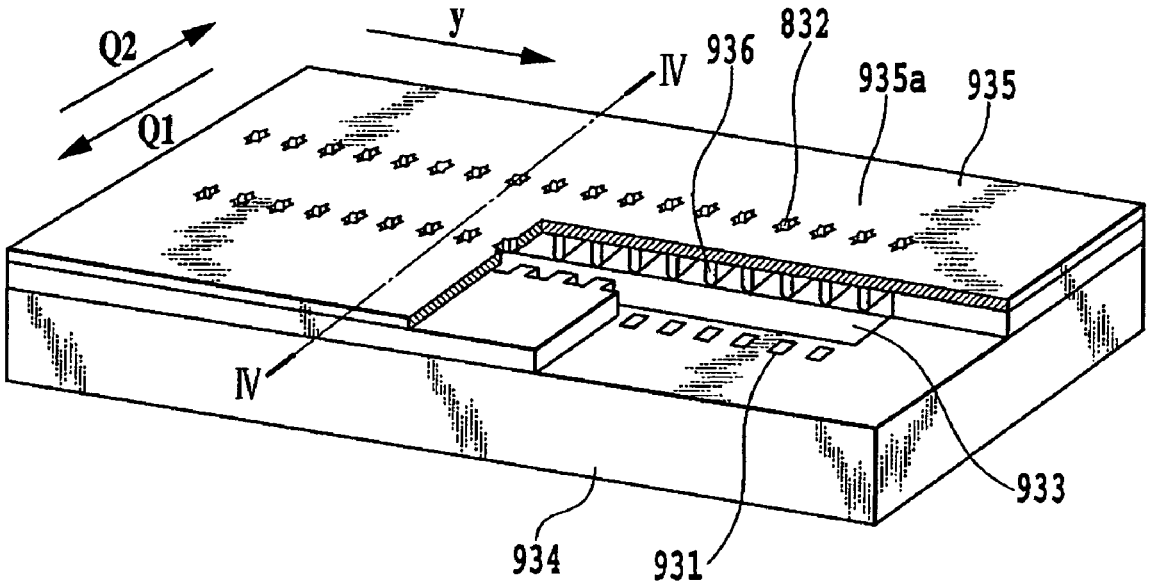
FIG. 3 is a schematic perspective view showing an essential portion of an ink jet print head applicable to the embodiment of this invention.

FIG. 3 is a perspective view schematically showing an essential part of an ink jet print head applicable to this embodiment. In the figure, denoted 934 is a substrate which, in this embodiment, is formed of glass, ceramic, plastic or metal and such like. The material of the substrate is not an essential point of this invention and is not limited to any particular material as long as the substrate can function as part of a flow path forming member and as a support member for ink ejection energy generation elements and for a material layer forming liquid paths and ink ejection nozzles described later. In this embodiment, a silicon substrate (wafer) is used.

The substrate 934 is formed with ink ejection nozzles as by laser beam or by an exposure device such as MPA (mirror projection aligner) using an orifice plate (nozzle plate) described later made of a photosensitive resin.

The substrate 934 is also formed with a plurality of electrothermal transducers (also referred to as heaters) 931 and with an ink supply port 933 in the form of an elongate groove that also functions as a common liquid chamber. The heaters 931, the thermal energy generation means, are arranged longitudinally on both aides of the ink supply port 933 at intervals corresponding to 600 dpi (dots/inch) for example. The two columns of heaters are staggered a half pitch from each other in a y direction and therefore they together can print at a density of 1200 dpi in the y direction.

On the substrate 934 are provided ink path walls 936 to introduce ink to where heaters are located. Further on the ink path walls 936 is placed an orifice plate 935 which has nozzles 832 for ejecting ink droplets by an energy applied to individual heaters. The orifice plate 935 is water-repellent finished on the nozzle surface side (935*a*). Each of the heaters 931 is applied a pulse voltage at a drive frequency of 10 kHz to be able to eject ink every about 100 μsec.

FIGS. 4-11 are head cross sections showing how an actual ink ejection operation is performed with elapse of time. Here, the cross sections of the print head are taken along the IV-IV line of FIG. 3.

Figure 4:
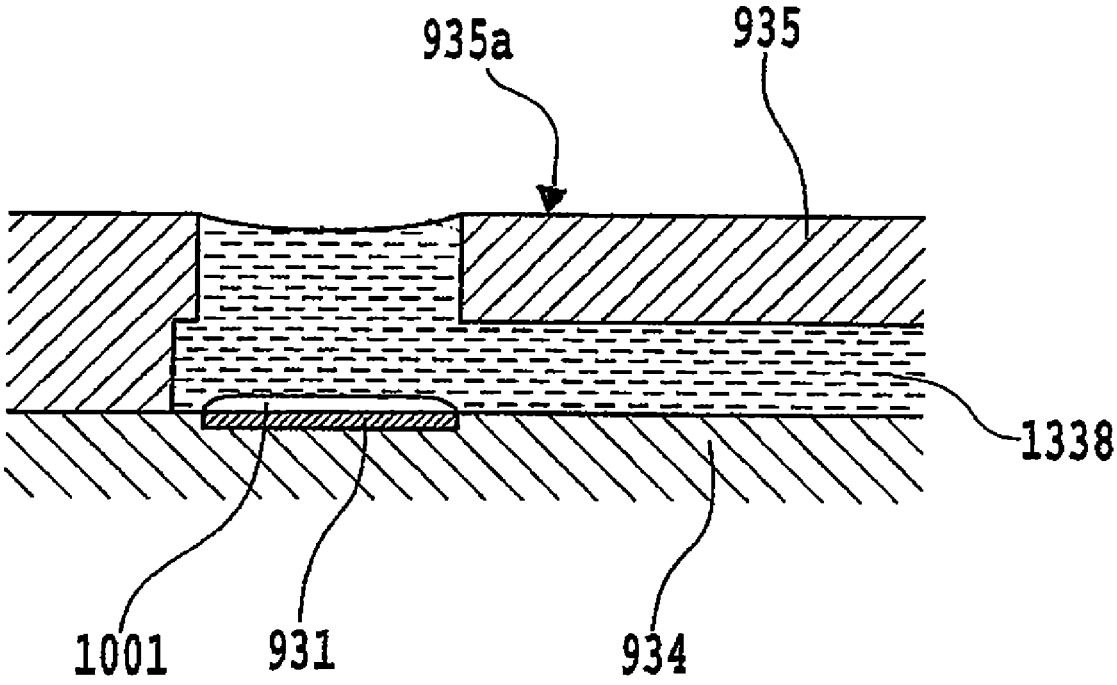
FIG. 4 is a cross-sectional view of the head showing an ejection operation with an elapse of time.
Figure 5:
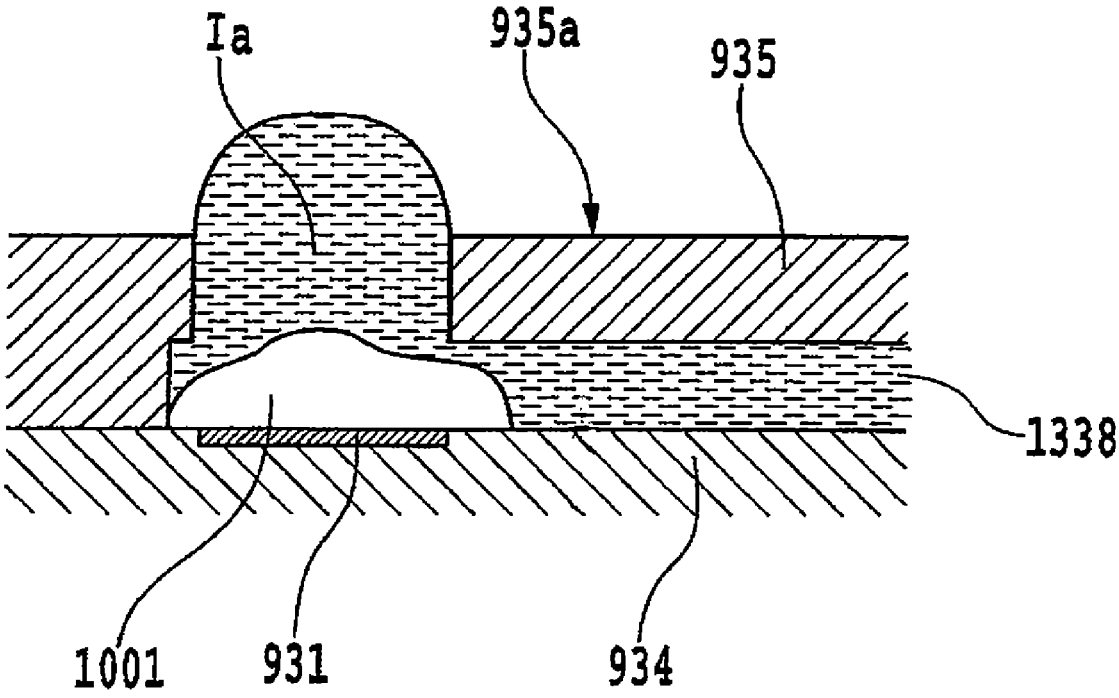
FIG. 5 is a cross-sectional view of the head showing an ejection operation with an elapse of time.
Figure 6:
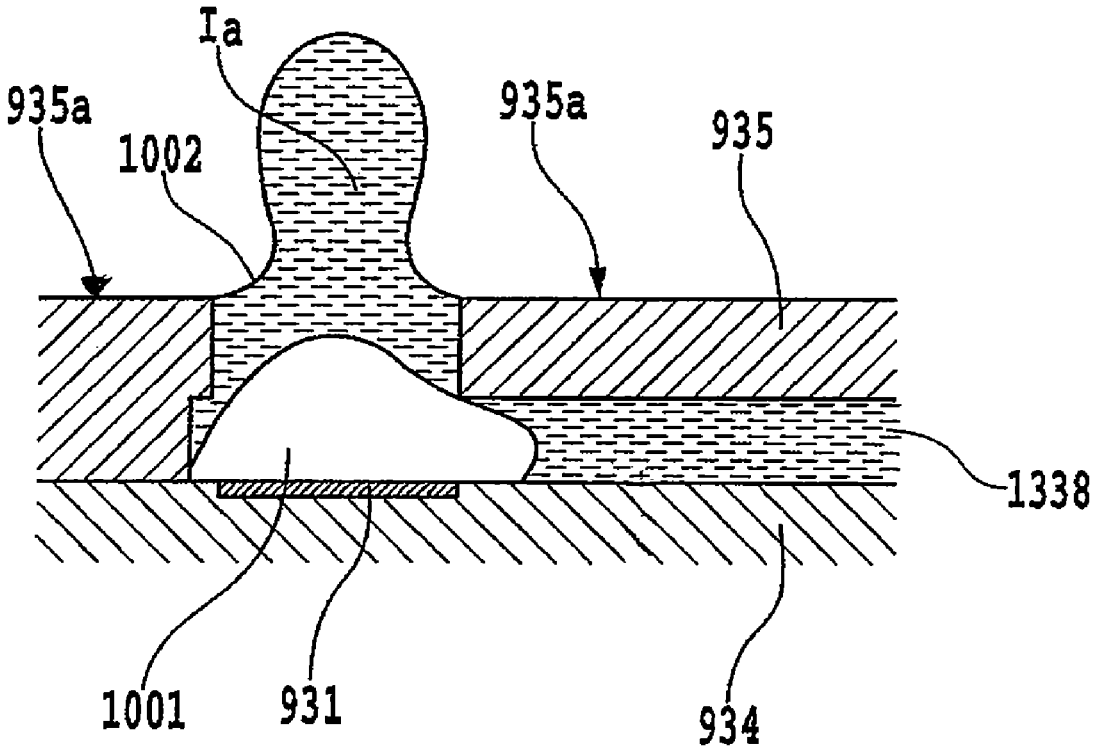
FIG. 6 is a cross-sectional view of the head showing an ejection operation with an elapse of time.
Figure 7:
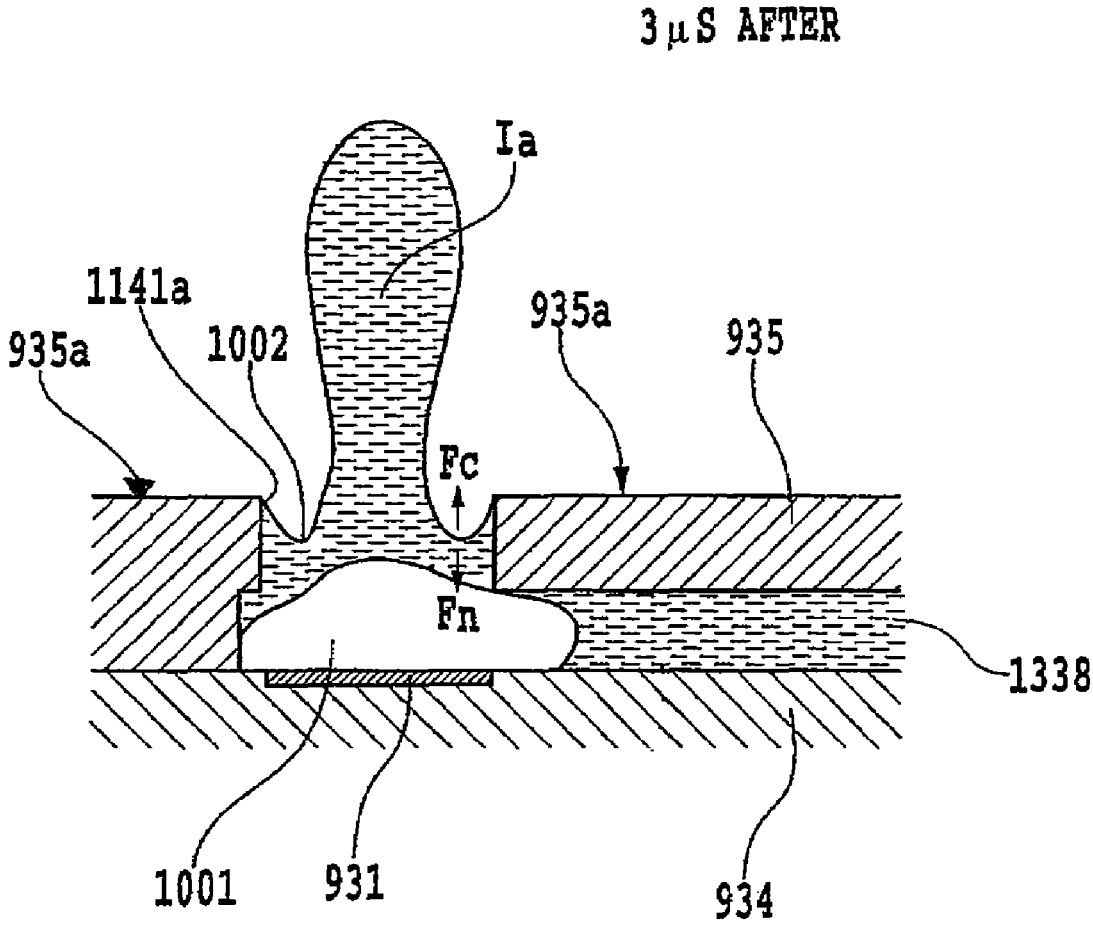
FIG. 7 is a cross-sectional view of the head showing an ejection operation with an elapse of time.
Figure 8:
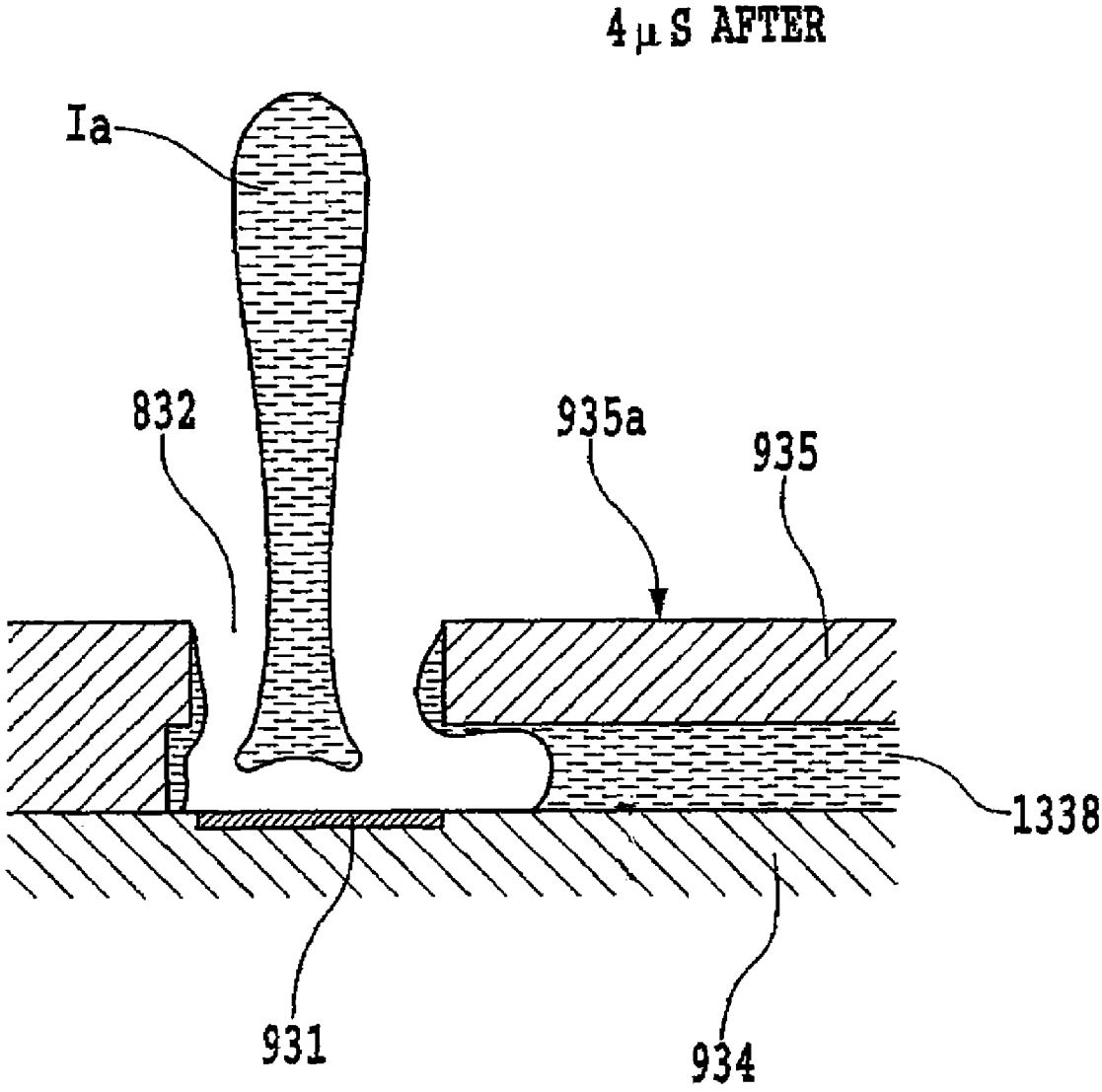
FIG. 8 is a cross-sectional view of the head showing an ejection operation with an elapse of time.
Figure 9:
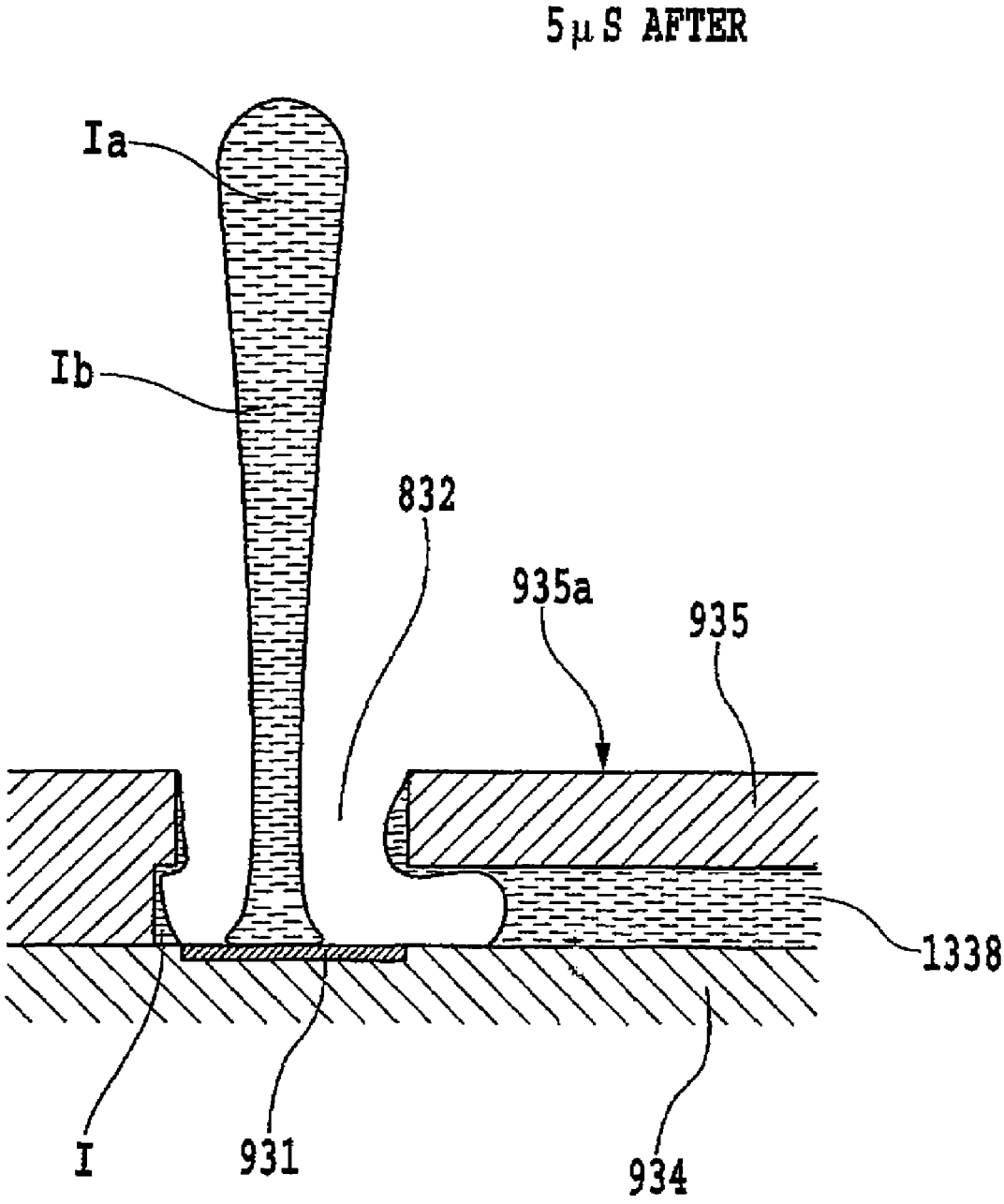
FIG. 9 is a cross-sectional view of the head showing an ejection operation with an elapse of time.
Figure 10:
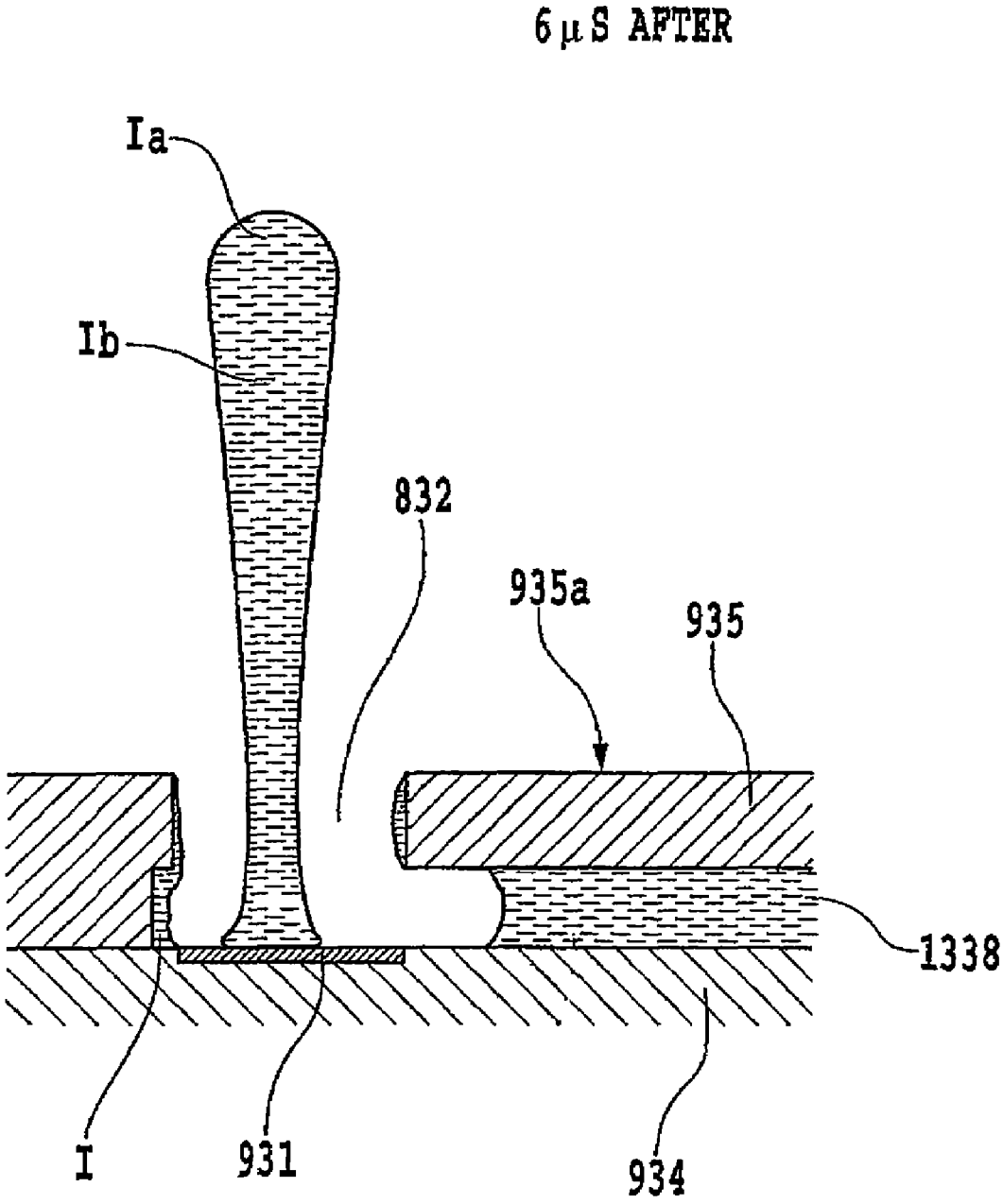
FIG. 10 is a cross-sectional view of the head showing an ejection operation with an elapse of time.
Figure 11:
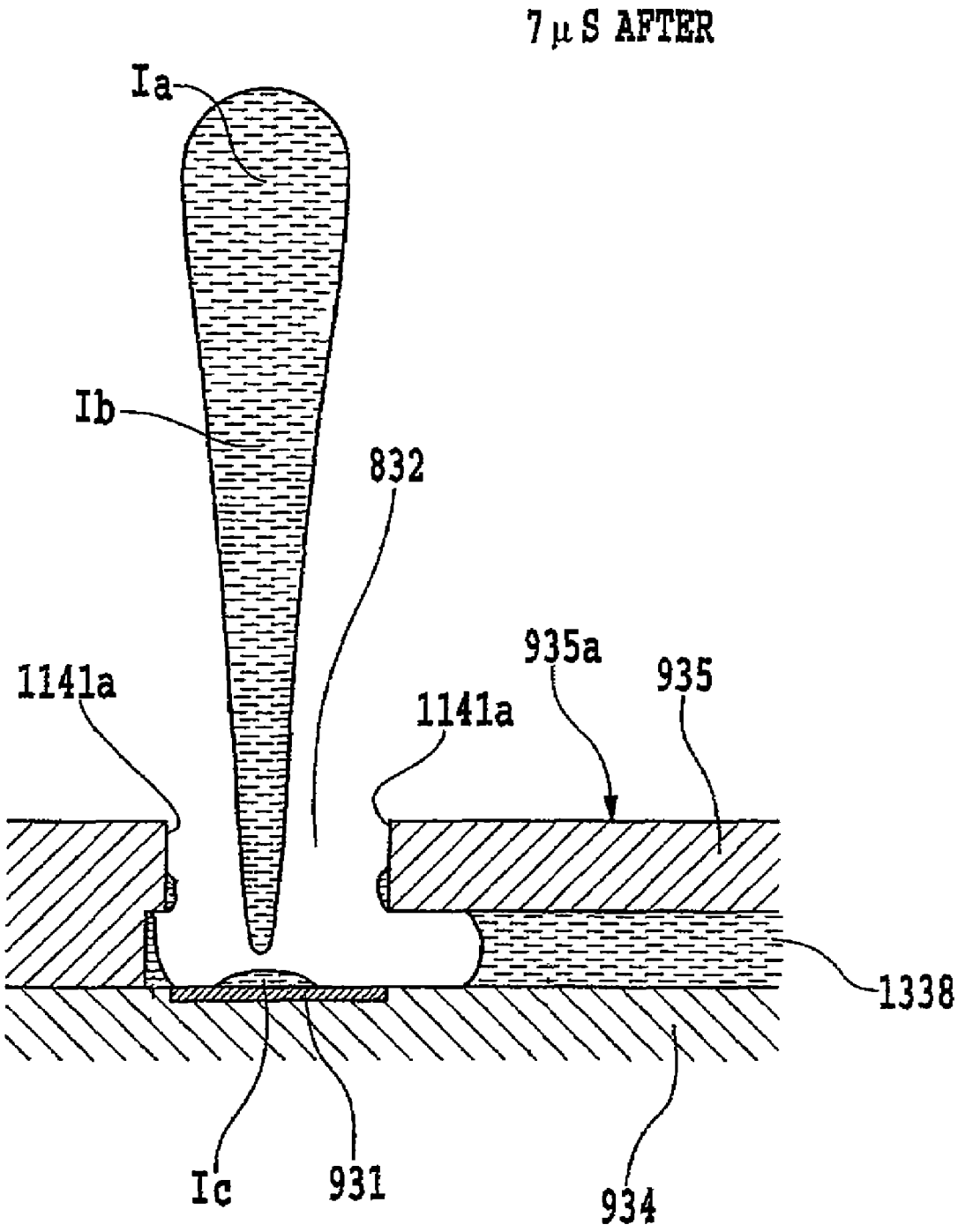
FIG. 11 is a cross-sectional view of the head showing an ejection operation with an elapse of time.

FIG. 4 shows a filmlike bubble being formed by the heater 931 as it is applied a pulse voltage. FIG. 5 shows a state about 1 μsec after the state of FIG. 4; FIG. 6 represents a state about 2 μsec later; FIG. 7 represents a state about 3 μsec later; FIG. 8 represents a state about 4 μsec later; FIG. 9 represents a state about 5 μsec later; FIG. 10 represents a state about 6 μsec later; and FIG. 11 represents a state about 7 μsec later. In the following explanation, words "drop or fall" or "allowed to fall" do not mean a fall in the gravitational direction but a movement toward the heater irrespective of the direction in which the head is mounted.

When the heater 931 is energized according to a print signal, a bubble 1001 is formed in a liquid path 1338 above the heater 931. The bubble 1001 rapidly expands as shown in FIG. 5 1 μsec later and FIG. 6 2 μsec later. When the bubble 1001 expands to its maximum volume, its height exceeds the nozzle surface 935*a*. The pressure of the bubble 1001 at this time is several to a dozen times smaller than the atmospheric pressure.

About 2 μsec after the generation of the bubble 1001, the bubble 1001 begins to decrease in volume and almost at the same time a meniscus 1002 begins to form. The meniscus 1002, as shown in FIG. 7, retracts toward the heater 931.

The falling speed of the meniscus 1002 is faster than the contracting speed of the bubble 1001. Therefore, about 4 μsec after the generation of a bubble, the bubble 1001 communicates with the atmosphere near the bottom surface of the nozzle 832 (FIG. 8). At the same time, the ink Ia near the center axis of the nozzle 832 begins to fall toward the heater 931. This is because the ink Ia, that was pulled back toward the heater 931 by the negative pressure of the bubble 1001 before the bubble communicated with the atmosphere, still retains the speed toward the heater 931 surface by inertia even after the bubble has communicated with the atmosphere.

The ink Ia falling toward the heater 931 reaches the surface of the heater 931 about 5 μsec after the generation of the bubble 1001 (FIG. 9). Then, the ink spreads over the surface of the heater 931 (FIG. 10). The ink that has spread over the surface of the heater 931 has a horizontal vector along the surface of the heater 931 but a vector in a direction perpendicular to the surface of the heater 931 vanishes. Thus, the ink tends to stay on the surface of the heater 931. A portion of the liquid somewhat above the heater surface, which retains a speed vector toward the ejection direction, is acted upon by a downward force.

Then, a portion Ib between the bottom part of ink that has spread over the surface of the heater 931 and the upper part of ink (main droplet) narrows and, about 7 μsec after the generation of the bubble 1001, the liquid portion Ib is cut off at the center of surface of the heater 931 (FIG. 11). As a result, the ink is separated into the main droplet Ia having a speed vector in the ejection direction and the ink Ic spread over the surface of the heater 931. The cut position of Ib is located preferably inside the liquid path 1338 and more preferably on the heater 931 side rather than nozzle 832 side.

The main droplet Ia thus generated is ejected from the central part of the nozzle 832 with no deviation in the ejection direction and lands at a target position on the print surface of the print medium. The ink Ic spread over the surface of the heater 931 stays on the heater surface and is not ejected.

Next, a pigment ink applicable to this embodiment will be explained. It is noted, however, that this invention is not limited to the example application of the pigment ink described below.

The pigment of the pigment ink used in this embodiment is 1-20% by weight of the total weight of the pigment ink and preferably 2-12 wt %. As a black pigment, carbon black may be used, which is made by the furnace method or channel method. It preferably has a first degree particle diameter of 15-40 mμ (nm), a BET method-based specific surface area of 50-300 $m^2/g$, a DBP absorbed oil volume of 40-150 ml/100 g, a volatile component of 0.5-10% and a pH value of 2-9. Products with the above characteristics available on the market include No. 2300, No. 900, MCF88, No. 33, No. 40, No. 45, No. 52, MA7, MA8, No. 2200B (these are from Mitsubishi Kasei), RAVEN1255 (Columbia make), REGAL400R, REGAL330R, REGAL660R, MOGUL L (these are from Cabot Corporation), Color Black FW1, Color Black FW18, Color Black S170, Color Black S150, Printex 35, Printex U (these are from Degussa).

Yellow pigments on the market include, for example, C. I. Pigment Yellow 1, C. I. Pigment Yellow 2, C. I. Pigment Yellow 3, C. I. Pigment Yellow 13, C. I. Pigment Yellow 16, and C. I. Pigment Yellow 83.

Magenta pigments on the market include, for example, C. I. Pigment Red 5, C. I. Pigment Red 7, C. I. Pigment Red 12, C. I. Pigment Red 48 (Ca), C. I. Pigment Red 48 (Mn), C. I. Pigment Red 57 (Ca), C. I. Pigment Red 112, and C. I. Pigment Red 122.

Cyan pigments on the market include, for example, C. I. Pigment Blue 1, C. I. Pigment Blue 2, C. I. Pigment Blue 3, C. I. Pigment Blue 15:3, C. I. Pigment Blue 16, C. I. Pigment Blue 22, C. I. Vat Blue 4, and C. I. Vat Blue 6. In addition to these pigments, newly manufactured pigments, such as self dispersion type pigments, can of course be used.

Any type of pigment dispersant may be used as long as it is water-soluble resin. It preferably has a weight-averaged molecular weight of 1,000-30,000 and more preferably 3,000-15,000. More specifically, pigment dispersants include: block copolymers composed of at least two or more monomers (at least one of which is a hydrophilic polymeric monomer), which are selected from among styrene, styrene derivatives, vinylnaphthalene, vinylnaphthalene derivatives, aliphatic alcohol ester of a,β-ethylenic unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acrylamide, and its derivatives; random copolymers; graft copolymers; or their salts. Further, natural resins such as rosin, shellac and starch may also be used in a preferable condition. These resins can be dissolved in a water solution of bases and are alkaline soluble resins. These water-soluble resins used as a pigment dispersant in the pigment ink are preferably 0.1-5 wt % of the total weight of pigment ink.

In the case of a pigment ink containing the above pigments, the whole pigment ink is preferably adjusted to be neutral or alkaline. This improves the solubility of water-soluble resins used as a pigment dispersant and thus provides a pigment ink with an excellent long-term preservability. In this case, however, since the alkaline liquid may corrode a variety of members used in the ink jet printing apparatus, it is desired that the pigment ink be adjusted in a pH range of 7-10. Possible pH adjusting agents include, for example, organic amines such as diethanolamine and triethanolamine, inorganic alkali agents such as hydroxides of alkaline metals, including sodium hydroxide, lithium hydroxide and potassium hydroxide, and organic acids and mineral acids. The above pigments and the water-soluble resins used as dispersants are dispersed or dissolved in a water-soluble medium.

In the pigment ink of this embodiment, the suitable aqueous liquid medium is a mixed solvent of water and water-soluble organic solvent. In this case, ion-exchanged water (deionized water) is preferably used, rather than commonly available water containing various ions.

The water-soluble organic solvents that are mixed with water include, for example, alkylalcohols with a carbon number of 1-4, such as methylalcohol, ethylalcohol, n-propylalcohol, isopropylalcohol, n-butylalcohol, sec-butylalcohol, and tert-butylalcohol; amides such as dimethyl formamide and dimethyl acetamide; ketones or ketoalcohols such as acetone and diacetone alcohol; ethers such as tetrahydrofuran and dioxane; polyalkyleneglycols such as polyethyleneglycol and polypropyleneglycol; alkyleneglycols with alkylene group having 2-6 carbon atoms, such as ethyleneglycol, propyleneglycol, butyleneglycol, triethyleneglycol, 1,2,6-hexanetriole, thiodiglycol, hexyleneglycol, and diethyleneglycol; glycerin; lower alkylethers of polyvalent alcohols such as ethyleneglycol monomethyl (or ethyl) ether, diethyleneglycol methyl (or ethyl) ether, and triethyleneglycol monomethyl (or ethyl) ether; and N-methyl-2-pyrrolidone, 2-pyrrolidone, and 1,3-dimethyl-2-imidazo-lidinone. Of these many water-soluble organic solvents, polyvalent alcohols such as diethylenglycol and lower alkylethers of polyvalent alcohols such as diethyleneglycol and triethyleneglycol monomethyl (or ethyl) ether are suitably applied.

A content of the above water-soluble organic solvents in the pigment ink is generally in a range of 3-50 wt % of the total weight of the pigment ink and more preferably in a 3-40 wt % range. A water content is 10-90 wt % of the total weight of the pigment ink and preferably 30-80 wt %.

To provide the pigment ink of this embodiment with desired properties, surfactant, antifoaming agent and preservative may be added to the pigment ink as required. It is strongly desired that a proper amount of surfactant that facilitates a quick soaking of a liquid component of the pigment ink into the print medium be added. The amount to be added is 0.05-10 wt % or more preferably 0.5-5 wt %. As for anionic surfactant, commonly available surfactants can suitably be used, such as carboxylate type, sulfate ester type, sulphonate type and phosphate type.

The above pigment ink may be made as follows. First, to an aqueous medium containing a water-soluble resin as dispersant and water, the above pigment is added and stirred. Then, a dispersing means described later is used to disperse the pigment and a centrifugal separation may be performed as required to obtain a desired dispersed liquid. Next, to this dispersed liquid, a sizing agent and suitably selected additive components described above are added and stirred to produce a pigment ink.

When an alkali-soluble type resin is used as a dispersant, a base needs to be added in order to dissolve the resin. The bases that are preferably used are organic amines, such as monoethanolamine, diethanolamine, triethanolamine, aminomethylpropanol and ammonia, or inorganic salts such as potassium hydroxide and sodium hydroxide.

In the method of making a pigment ink containing a pigment, an aqueous medium containing the pigment is stirred and, prior to dispersion processing, it is effective to perform a mixing for more than 30 minutes. This is because the premixing operation improves a wettability on the pigment surface and promotes adsorption of the dispersant onto the pigment surfaces.

The dispersing machine used during the pigment dispersing processing may be any type of commonly used machine, for example, a ball mill, roll mill and sand mill. Of these the high-speed sand mill is preferably used. Such machines include, for example, Super mill, Sand grinder, Beads mill, Agitator mill, Glen mill, Dyno-mill, Pearl mill and Cobol mill (all tradenames).

An ink jet printing apparatus applying pigment inks in general select pigments with an optimum grain size distribution to prevent clogging of nozzles as much as possible. To obtain a desired grain size distribution may involve reducing the size of crushing media in the dispersing machine, increasing a charge ratio of the crushing media, prolonging a processing time, slowing an ejection speed, and classifying crushed grains by filter and centrifugal separator. These methods may also be combined as required.

Now, effects and components of the coagulation inhibiting liquid applied in this embodiment will be explained in the following. An ink, whose colorant is dispersed by an electric repelling force (see FIG. 20A), coagulates when the electric repelling force disappears, thus forming coagulated substances (see FIG. 20B). In a pigment ink adhering to the surface of a print medium, the electric repelling force among the pigment particles is lost by cation components on the print medium surface. As a result, the pigment particles coagulate, bulged on the surface, and become fixed there.

Figure 12A:
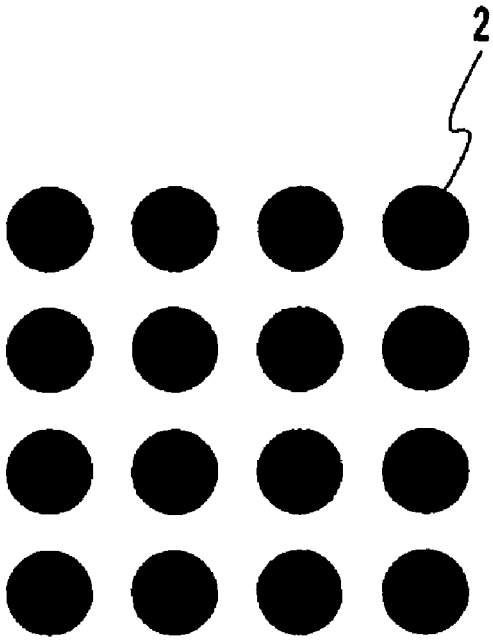
FIGS. 12A and 12B are schematic diagrams showing how ink fixes on a print medium when an image is formed using only the ink with a coagulating property.
Figure 12B:
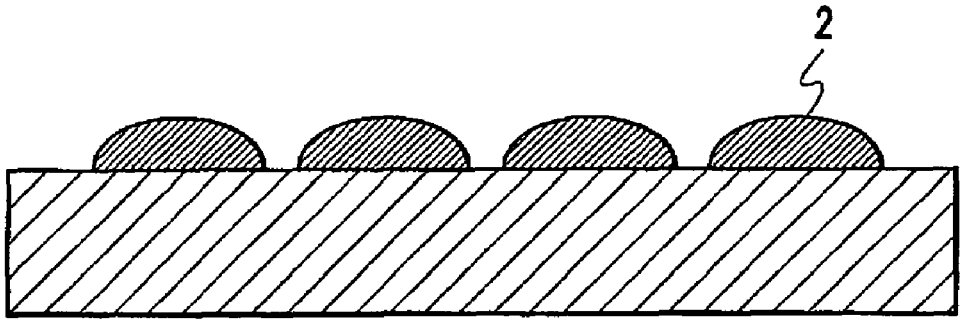

FIGS. 12A and 12B are schematic diagrams showing a fixed state of an ink 2 when an image is formed on a print medium using only the ink containing a colorant with a coagulating property. FIG. 12A shows the print medium as seen from above. FIG. 12B shows a cross section of the printed medium of FIG. 12A. When dots are formed of only the ink 2, they have a relatively clear outline on the print medium and are fixed there bulged by the coagulated colorant. Therefore, the print medium after being printed becomes rougher than before the printing and loses its glossiness at the printed portions.

Figure 13A:
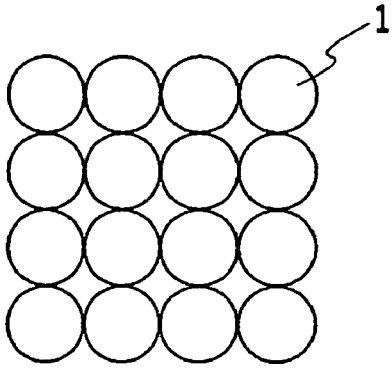
FIGS. 13A to 13D are schematic diagrams showing printed states when images are formed using an ink with a coagulating property and a coagulation inhibiting liquid.
Figure 13B:
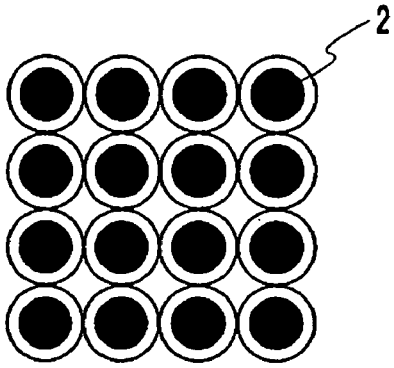
Figure 13C:
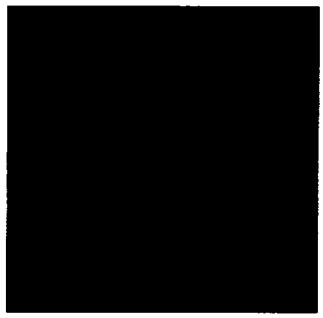
Figure 13D:
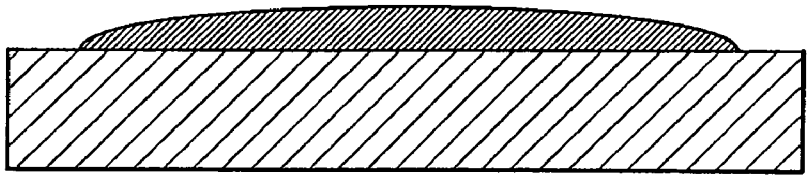
Figure 14A:
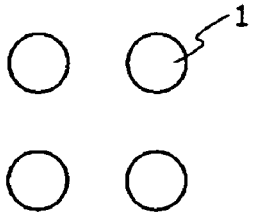
FIGS. 14A to 14H are schematic diagrams showing printed states when images are formed using an ink with a coagulating property and a coagulation inhibiting liquid.
Figure 14D:
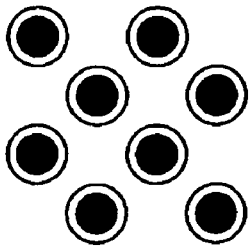
Figure 14G:
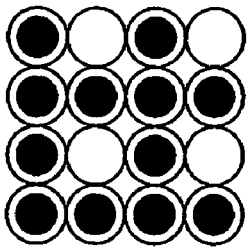
Figure 14B:
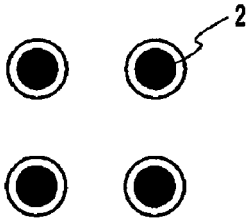
Figure 14E:
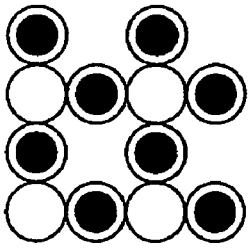
Figure 14H:
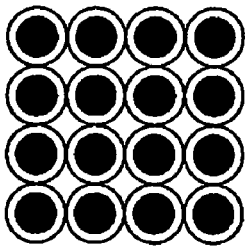
Figure 14C:
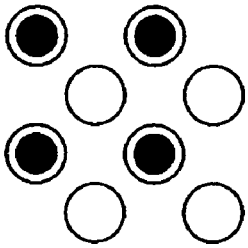
Figure 14F:
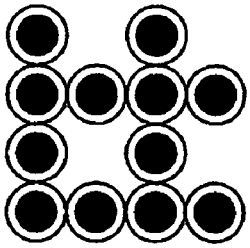

FIGS. 13A to 13D show printed states when an image is formed using the ink 2 and the coagulation inhibiting liquid 1 that inhibits coagulation of the colorant contained in the ink. FIG. 13A is a schematic diagram representing a state of the coagulation inhibiting liquid 1 applied to the print medium. FIG. 13B is a schematic diagram showing the ink 2 applied over the coagulation inhibiting liquid 1. At this stage, because its colorant coagulation is inhibited by the coagulation inhibiting liquid 1, the ink 2, still fluid, soaks into the print medium as it spreads. FIG. 13C is a schematic diagram showing the printed dots finally fixed in the print medium. FIG. 13D is a cross section of the printed medium of FIG. 13C. In this state, since the ink 2 has soaked into the print medium as it spreads together with the coagulation inhibiting liquid 1, the dot bulginess is reduced compared with FIG. 12B. As a result, the surface roughness of the printed portions is minimized, maintaining the glossiness of the print medium.

FIGS. 14A to 14H show printed states when an image is formed by applying the ink 2 and the coagulation inhibiting liquid 1 in a way different from that of FIGS. 13A to 13C. A serial type ink jet printing apparatus such as shown in FIG. 1 often employs a so-called multipass printing method that forms an image by dividing the same image area into a plurality of main scans. With this multipass printing, a plurality of dots to be formed on the same image area on the print medium are progressively printed at different timings or in two or more scans. FIGS. 14A to 14H show dots landing on the print medium in succession during the multipass printing.

At each timing of FIGS. 14A to 14H, the coagulation inhibiting liquid 1 and the ink 2 are applied alternately, four dots at a time, to the same position. That is, at a first step (FIG. 14A), four dots of the coagulation inhibiting liquid 1 are applied, and at the next step (FIG. 14B) four dots of the ink 2 are applied to the same position as the coagulation inhibiting liquid 1. At the next step (FIG. 14C), four dots of the coagulation inhibiting liquid 1 land on a position different from the previous position, and at the subsequent step, four dots of the ink land on the same position that the coagulation inhibiting liquid 1 landed in the step of FIG. 14C. This process is repeated also in the subsequent steps of FIGS. 14E-14H, completing the entire image that is supposed to be printed in a predetermined area (which is four dots wide in the subscan direction and a print medium width long in the main scan direction) in a total of eight steps.

Figure 15:
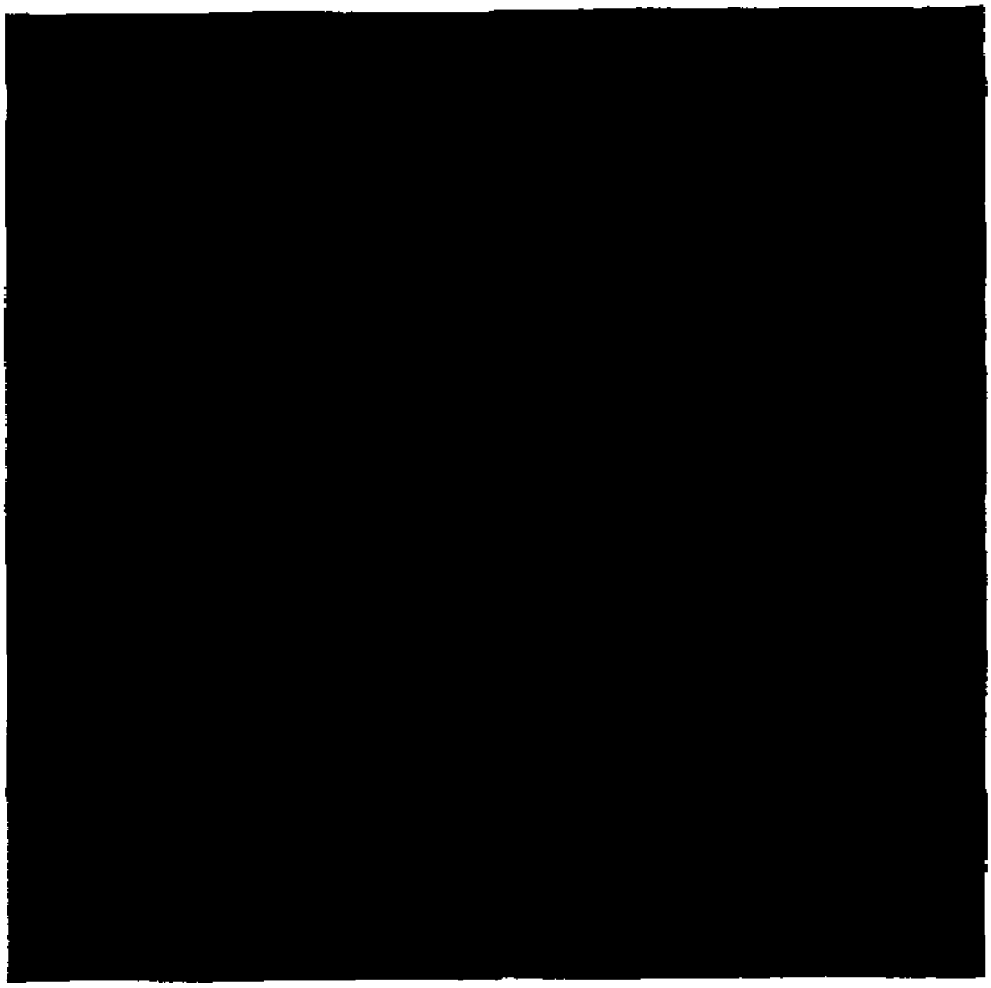
FIG. 15 is a schematic diagram showing a printed state when an image is formed using an ink with a coagulating property and a coagulation inhibiting liquid.

In this multipass printing, too, all dots are formed by applying the ink 2 only after the coagulation inhibiting liquid 1 has been applied. Therefore, the dots are spread thin as they are fixed, as shown in FIG. 15. So the surface roughness of the printed portions is minimized retaining the glossiness of the print medium. The control of dot printing order depends on the order of nozzle groups arranged in the print head 104. Thus, by placing the coagulation inhibiting liquid nozzle group at a position where it can eject the liquid before the ink, a construction can easily be realized that applies the coagulation inhibiting liquid first, followed by the ink.

While in the above the printing method has been explained which applies the ink 2 only after the coagulation inhibiting liquid 1 has been applied, this invention is not limited to the above application order. For example, the application of the coagulation inhibiting liquid may be followed by the ink and then by the coagulation inhibiting liquid again. Or they may be applied almost simultaneously. These application orders can also produce the intended effect of the invention.

Figure 20A:
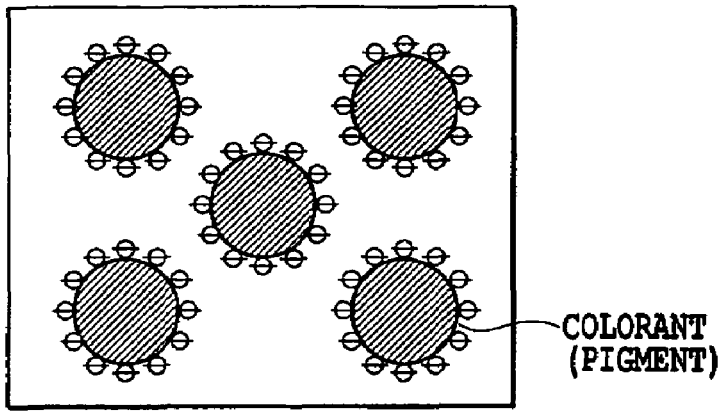
FIGS. 20A to 20C are diagrams explaining an effect of steric hindrance caused by a coagulating inhibitor.
Figure 20B:
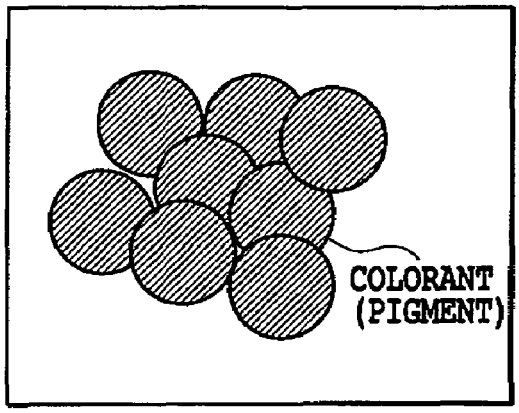
Figure 20C:
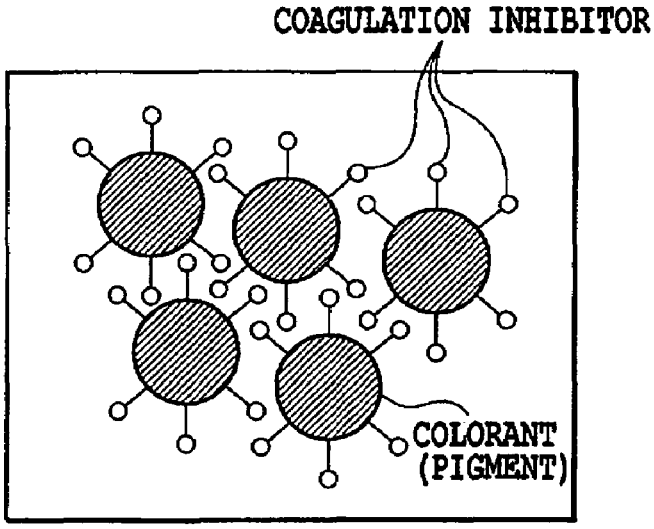

The coagulation inhibiting liquid applicable to this invention needs only to be able to disperse pigment particles by an effect of steric hindrance if electric repulsive force is lost (see FIG. 20C). Example materials of the coagulation inhibiting liquid may include nonionic surfactant BC40 (Nikko Chemical make) and BC20 (Nikko Chemical make). Particularly nonionic surfactant with five or more ethyleneoxide groups can be effectively used.

Now, referring to FIGS. 20A to 20C, let us explain about the effect of steric hindrance brought about by a coagulation inhibitor which is applicable to this embodiment. As shown in FIG. 20A, the colorant (pigment) particles are dispersed in the liquid by electric repulsive force. Before the pigment ink is ejected from the print head, namely, when the pigment particles are in the liquid, their state is as shown in FIG. 20A. When the pigment ink is ejected from the print head and lands on the print medium, the colorant (pigment) particles react with cation components on the print medium surface and lose the electric repulsive force, coagulating on the surface (FIG. 20B). Such coagulates retain distinguishable outlines of individual dots, forming relatively large undulations on the surface of the print medium, which in turn degrades the glossiness of the print medium. As the liquid penetrates into the print medium, the solid particles are separated from liquid.

This embodiment, therefore, uses a coagulation inhibitor that prevents contact among pigment particles (this is hereinafter referred to as an effect of steric hindrance) to minimize the coagulation of colorant on the print medium and thereby alleviate the formation of undulations on the print medium surface. More specifically, a coagulation inhibitor material is prepared which can adsorb to the surface of the pigment particles and act to block the pigment particles from contacting one another, as shown in FIG. 20C, and this coagulation inhibitor is applied to the print medium at specified timings. As a result, if the pigment particles lose their electric repulsion when the pigment ink is applied to the print medium, the coagulation inhibitor adsorbs to the surface of the pigment particles preventing the contact among the pigment particles. The pigment particles therefore are made unlikely to coagulate, alleviating the undulations on the surface of the print medium.

A suitable aqueous medium for the coagulation inhibiting liquid used in this invention is a mixture of water and a water-soluble organic solvent. The water is preferably ion-exchanged water (deionized water), rather than city water containing various ions.

The water-soluble organic solvents that are mixed with water include, for example, alkylalcohols with a carbon number of 1-4, such as methylalcohol, ethylalcohol, n-propylalcohol, isopropylalcohol, n-butylalcohol, sec-butylalcohol, and tert-butylalcohol; amides such as dimethyl formamide and dimethyl acetamide; ketones or ketoalcohols such as acetone and diacetone alcohol; ethers such as tetrahydrofrane and dioxane; polyalkyleneglycols such as polyethyleneglycol and polypropyleneglycol; alkyleneglycols with alkylene group having 2-6 carbon atoms, such as ethyleneglycol, propyleneglycol, butyleneglycol, triethyleneglycol, 1,2,6-hexanetriole, thiodiglycol, hexyleneglycol, and diethyleneglycol; glycerin; lower alkylethers of polyvalent alcohols such as ethyleneglycol monomethyl (or ethyl) ether, diethyleneglycol methyl (or ethyl) ether, and triethyleneglycol monomethyl (or ethyl) ether; and N-methyl-2-pyrrolidone, 2-pyrrolidone, and 1,3-dimethyl-2-imidazo-lidinone. Of these many water-soluble organic solvents, polyvalent alcohols such as diethylenglycol and lower alkylethers of polyvalent alcohols such as triethyleneglycol monomethyl (or ethyl) ether are suitably applied.

A content of the above water-soluble organic solvents in the pigment ink is generally in a range of 3-50 wt % of the total weight of the pigment ink and more preferably in a 3-40 wt % range. A water content is 10-90 wt % of the total weight of the pigment ink and preferably 30-80 wt %.

The coagulation inhibiting liquid of this invention that inhibits coagulation of ink may be a lightly colored liquid containing colorants such as dye or pigment, in addition to a colorless, clear liquid.

According to the above embodiment, the coagulation inhibiting liquid is applied to those positions on a glossy print medium where ink is to be applied. This ensures that the ink, when applied, will quickly soak into a reception layer of the print medium without coagulating on the surface, with the result that the formation of undulations on the print medium surface are minimized, maintaining the glossiness of the print medium.

Examples for verification and comparison implemented by the inventors of this invention to confirm the effects of this embodiment will be explained in the following. In the following description, parts and percent are based on weight unless otherwise specifically stated.

Example for Verification

According to a process described below, pigment inks of black, cyan, magenta and yellow containing pigments and anionic compounds, and coagulation inhibiting liquid were produced.

Coloring Ink K

< Making Pigment Dispersion Liquid>

| | |
|---|---|
| Styrene-acrylic acid-ethylacrylate copolymer (acid value 240, weight-averaged molecular weight = 5,000) | 1.5 parts |
| Monoethanolamine | 1.0 part |
| Diethyleneglycol | 5.0 parts |
| Ion-exchanged water | 81.5 parts |

The above components were mixed together and heated to 70° C. in water bath to completely dissolve resin component. To this solution, 10 parts of newly prepared carbon black (MCF88, Mitsubishi Kasei make) and one part of isopropylalcohol were added; and they were subjected to 30 minutes of premixing and then to dispersion processing under the following conditions.

Dispersion machine: sand grinder (Igarashi Kikai make)

Crushing media: zirconium beads 1 mm in diameter

Charging factor of crushing media: 50% (by volume)

Crushing time: 3 hours

They were also subjected to a centrifugal separation process (12,000 rpm for 20 minutes) to remove coarse particles to make a pigment-dispersed liquid.

< Making Coloring Ink K>

Using the above dispersion liquid, components having the following composition ratio were mixed to manufacture an ink containing a pigment for use as a coloring ink.

| | |
|---|---|
| The above pigment-dispersed liquid | 30.0 parts |
| Glycerin | 10.0 parts |
| Ethyleneglycol | 5.0 parts |
| N-methylpyrrolidone | 5.0 parts |
| Ethylalcohol | 2.0 parts |
| Acetylenol EH (Kawaken Fine Chemical) | 1.0 part |
| Ion-exchanged water | 47.0 parts |

Coloring Ink C 10 parts of carbon black (MCF88, Mitsubishi Kasei make) used to make the coloring ink K was used in place of Pigment Blue 15 to make a coloring ink C in the same way as manufacturing the coloring ink K.

Coloring Ink M 10 parts of carbon black (MCF88, Mitsubishi Kasei make) used to make the coloring ink K was used in place of Pigment Red 7 to make coloring ink M in the same way as manufacturing the coloring ink K.

Coloring Ink Y 10 parts of carbon black (MCF88, Mitsubishi Kasei make) used to make the coloring ink K was used in place of Pigment Yellow 74 to make coloring ink Y in the same way as manufacturing the coloring ink K.

Coagulation Inhibiting Liquid P

The following components were mixed and dissolved and then filtered under pressure by a membrane filter with a pore size of 0.22 μm (product name: Floropore Filter, Sumitomo Denko make) to produce a coagulation inhibiting liquid P.

<Composition of Coagulation Inhibiting Liquid P>

| | |
|---|---|
| Diethyleneglycol | 10.0 parts |
| Methylalcohol | 5.0 parts |
| BC40 (Nikko Chemical make) | 10.0 parts |
| Acetylenol EH (Kawaken Fine Chemical) | 0.1 part |
| Ion-exchanged water | 74.9 parts |

Next, the coagulation inhibiting liquid P was poured into an ink tank of BCI-6BK (Canon make), the coloring ink K into an ink tank of BCI-6PM (Canon make), the coloring ink into an ink tank of BCI-6C (Canon make), the coloring ink M into an ink tank of BCI-6M (Canon make), and the coloring ink Y into an ink tank of BCI-6Y (Canon make). Then, these tanks were mounted on a tank holder of the ink jet printing apparatus BJF900 so that the four coloring inks and the coagulation inhibiting liquid P could be ejected from the print head. The ink head has nozzle groups for these inks and liquid arranged as shown in FIG. 16. Printing an image in a one-way printing mode using the print head with the above arrangement causes inks and liquid to be applied to the print medium in the order of coagulation inhibiting liquid P, black ink K, cyan ink C, magenta ink M and yellow ink Y.

Then, BJF900 was connected to the host computer and controlled in a way that differs from the product apparatus, to perform printing at a vertical and horizontal resolution of 200 dpi (dots/inch). Here, the control different from the product apparatus means generating ejection data that causes the coagulation inhibiting liquid 1 to be ejected to the same position where the four color pigment inks are to be ejected.

Under the above printing control, solid patterns (with 100% duty), 3 cm long by 3 cm wide, were printed for black, cyan, magenta and yellow. The print medium used was professional photopaper (Canon make), a type of glossy paper.

After samples were printed, an image clarity of the printed areas was measured for all samples. For the measurement an image clarity meter ICM-1T (Suga Shikenki make) was used. The result of measurement showed that the image clarity of a 2-mm optical comb was 72 for black, 60 for cyan, 65 for magenta and 75 for yellow. No glossiness difference between the printed areas and the non-printed areas was observed with a visual check.

Example for Comparison

In a configuration similar to the above verification example except that the coagulation inhibiting liquid 1 was not used, samples were printed and their image clarity measured. The result of measurement showed that the image clarity of a 2-mm optical comb was 34 for black, 42 for cyan, 46 for magenta and 49 for yellow. A visual check revealed a glossiness difference between the printed areas and the non-printed areas.

Second Embodiment

In the first embodiment, the method of printing on a glossy print medium has been described. In the case of a non-glossy print medium such as plain paper, the merit and feature of the pigment ink may be better taken advantage of by not applying the coagulation inhibiting liquid. In such a case it is preferred to determine whether or not to apply the coagulation inhibiting liquid according to the kind of print medium used.

In this embodiment, therefore, whether the coagulation inhibiting liquid should be applied or not is determined according to the kind of print medium used. This embodiment is explained in detail as follows. The basic construction of the printing apparatus is similar to that of the first embodiment, so only those portions that differ from the first embodiment will be explained.

Figure 17:
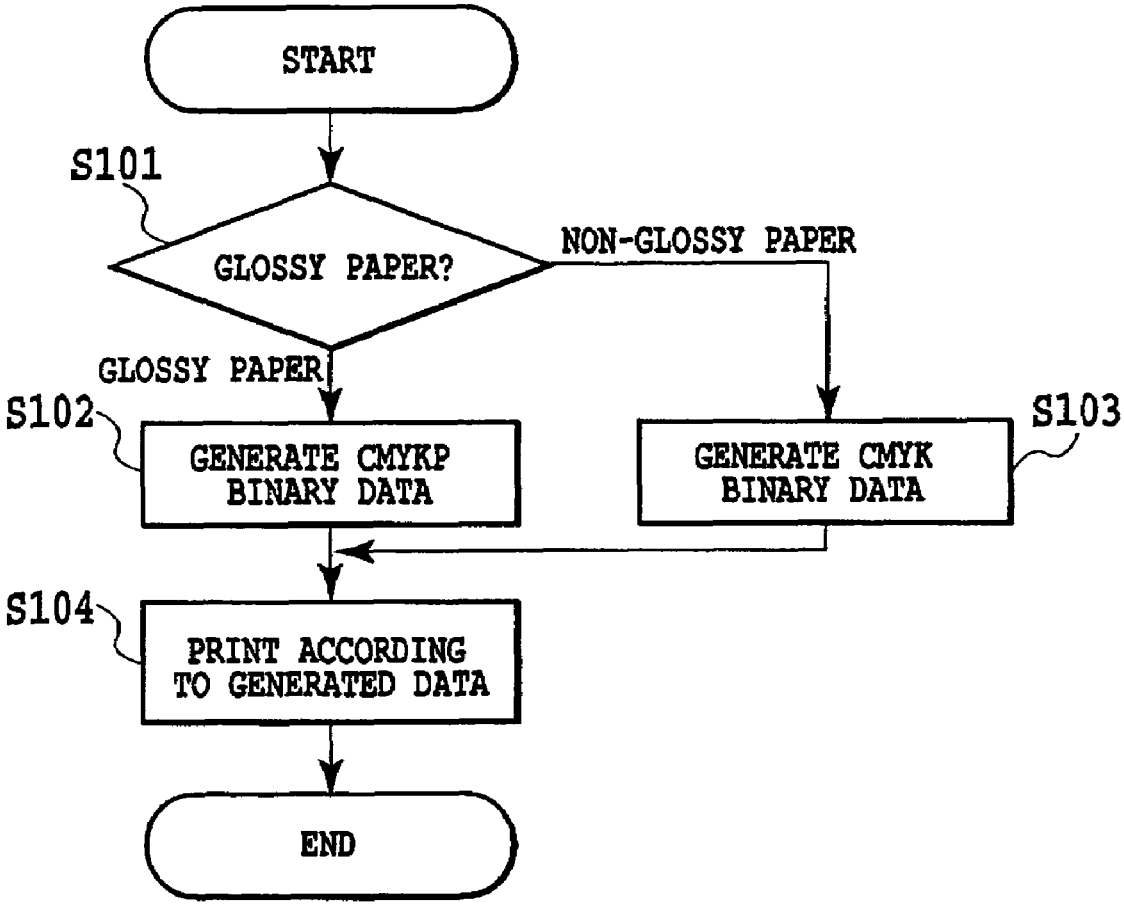
FIG. 17 is a flow chart showing a sequence of a printing operation in a second embodiment of this invention.

FIG. 17 is a flow chart showing a sequence of steps in the printing operation of this embodiment. First, step S101 determines the kind of print medium. For example, on a property window of a printer driver started by a print request from an application, the user selects one of print mediums (plain paper, high-quality paper, printable disk, glossy paper, glossy film, etc.). The printer driver then retrieves information on the kind of print medium and determines the kind of the print medium. The method of determining the kind of print medium is not limited to this method. For example, the decision on the kind of print medium may be made according to the selection the user has made of the print medium by using a display or switch on the printing apparatus. It is also possible to provide an optical sensor in the printing apparatus to automatically determine the kind of print medium.

If at step S101 it is decided that the print medium is a glossy print medium, such as glossy paper and glossy film, the processing proceeds to step S102. If it is a non-glossy print medium such as plain paper, high-quality paper and printable disk, the processing moves to step S103.

At step S102, to take advantage of the glossiness of the glossy medium, a coagulation inhibiting liquid is used in addition to the coloring inks containing colorants during the printing operation. More specifically, when the printing apparatus receives CMYK multivalued data from the printer driver, it converts the CMYK multivalued data into CMYK binary data. Then, the CMYK binary data are logically ORed to generate binary data for ejecting the coagulation inhibiting liquid (P). Then, the processing proceeds to step S104 where it ejects the color inks and the coagulation inhibiting liquid from the print head onto the print medium according to the CMYKP binary data to form an image.

In step S103, on the other hand, to form a high density image by increasing the amount of colorant coagulates remaining on the surface of the print medium, the coagulation inhibiting liquid is not used in printing. More specifically, when the printing apparatus receives CMYK multivalued data from the printer driver, it converts the CMYK multivalued data into CMYK binary data. Then, the processing proceeds to step S104 where it ejects the color inks from the print head onto the print medium according to the CMYK binary data to form an image.

According to the above embodiment, when an image is formed on a glossy print medium, the coagulation inhibiting liquid applied in addition to inks allows the inks to quickly soak into the print medium without coagulating on the surface. As a result, the formation of undulations on the surface of the print medium is minimized, maintaining the glossiness of the print medium. On the other hand, when an image is formed on a non-glossy print medium (e.g., plain paper), because the coagulation inhibiting liquid is not used, a large amount of colorant coagulates can be left on the surface of the print medium, making it possible to produce a high-density image.

Third Embodiment

Next, a third embodiment will be described. The basic construction of the printing apparatus is similar to that of the first embodiment, so only those portions that differ from the first embodiment will be explained.

In the first and second embodiment, the coagulation inhibiting liquid is applied to all locations where inks are applied, as shown in FIGS. 13A-13D and FIGS. 14A-14H. It is noted, however, that this invention is not limited to this configuration. For example, where the degree of coagulation of colorants is not so strong or the degree of coagulation inhibition by the coagulation inhibiting liquid is strong, the coagulation inhibiting liquid may be applied to only a part of the locations where inks are to be applied.

An example construction to realize this method may involve thinning a part of ejection data for the coagulation inhibiting liquid (P) generated as described above or making the dot diameters of the coagulation inhibiting liquid smaller than those of inks.

With this embodiment, the consumption of the coagulation inhibiting liquid and the running cost can be minimized. Because the total amount of liquid applied to the print medium is reduced, cockling (wrinkles of print medium that occur after printing) is rendered unlikely.

Fourth Embodiment

Next, a fourth embodiment will be described. The basic configuration of the printing apparatus is similar to that of the first embodiment, so only those portions that differ from the first embodiment will be explained.

In the first, second and third embodiments, a construction has been described which uses inks containing colorants and a coagulation inhibiting liquid that inhibits coagulation of the colorants contained in the inks. The present invention is not limited to this construction. The intended effect of this invention can also be produced if a liquid containing a component that coagulates the colorant in ink (hereinafter referred to as a "reaction liquid") is additionally used.

Here, the reaction liquid is defined to be a liquid having a component that acts to coagulate a colorant contained in ink. If a pigment ink is used which contains a pigment dispersed by an electric repelling force, the reaction liquid suitably includes a polyvalent metal salt which is a reaction component that eliminates this electric repelling force. The polyvalent metal salt is composed of divalent or higher metal ions and anions that combine with these polyvalent metal ions. Examples of polyvalent metal ions include divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. Examples of anions include $Cl^{-}$, $NO^{3-}$ and $SO^{4-}$. To make the reaction occur instantaneously to quickly form a coagulated film, it is desired that a total electric charge concentration of polyvalent metal ions in the reaction liquid be more than twice that of ions of opposite polarity contained in the coloring pigment ink.

Water-soluble organic solvents that can be used as a reaction liquid include, for example, amides such as dimethylformamide and dimethylacetamide; ketones such as acetone; ethers such as tetrahydroflane and dioxane; polyalkyleneglycols such as polyethyleneglycol and polypropyleneglycol; alkyleneglycols such as ethyleneglycol, propyleneglycol, butyleneglycol, triethyleneglycol, 1,2,6-hexanetriole, thiodiglycol, hexyleneglycol and diethyleneglycol; lower alkylethers of polyvalent alcohol of ethyleneglycol methylether, diethyleneglycol monomethylether and triethyleneglycol monomethylether; monovalent alcohols such as ethanol, isopropylalcohol, n-butylalcohol and isobutylalcohol; and glycerin, N-methyl-2-pyrrolidone, 1,3-dimethyl-imidazolydinone, triethanolamine, sulfolane, and dimethylsulfoxide. Although there is no particular limitations on the content of the above water-soluble organic solvent in the reaction liquid, it is preferably 5-60 wt % of the total weight of the reaction liquid and more preferably 5-40 wt %.

To the reaction liquid, additives such as viscosity adjusting agent, pH adjusting agent, preservative and antioxidant may be added as required. The selection of surfactant that functions as a penetration accelerator and the amount of surfactant as additive requires caution in restricting the penetrability of the reaction liquid into the print medium. Although the reaction liquid is preferably colorless, it may be light-colored to such a degree that it will not change the tone of the coloring inks when it is mixed with the inks on the print medium. Further, the properties of the above reaction liquid are preferably adjusted so that its viscosity at around 25° C. is in a range of 1-30 cps.

Now, the printing operation of this invention will be explained. In this embodiment, whether or not to apply the coagulation inhibiting liquid and the reaction liquid is determined according to the kind of print medium used.

Figure 18:
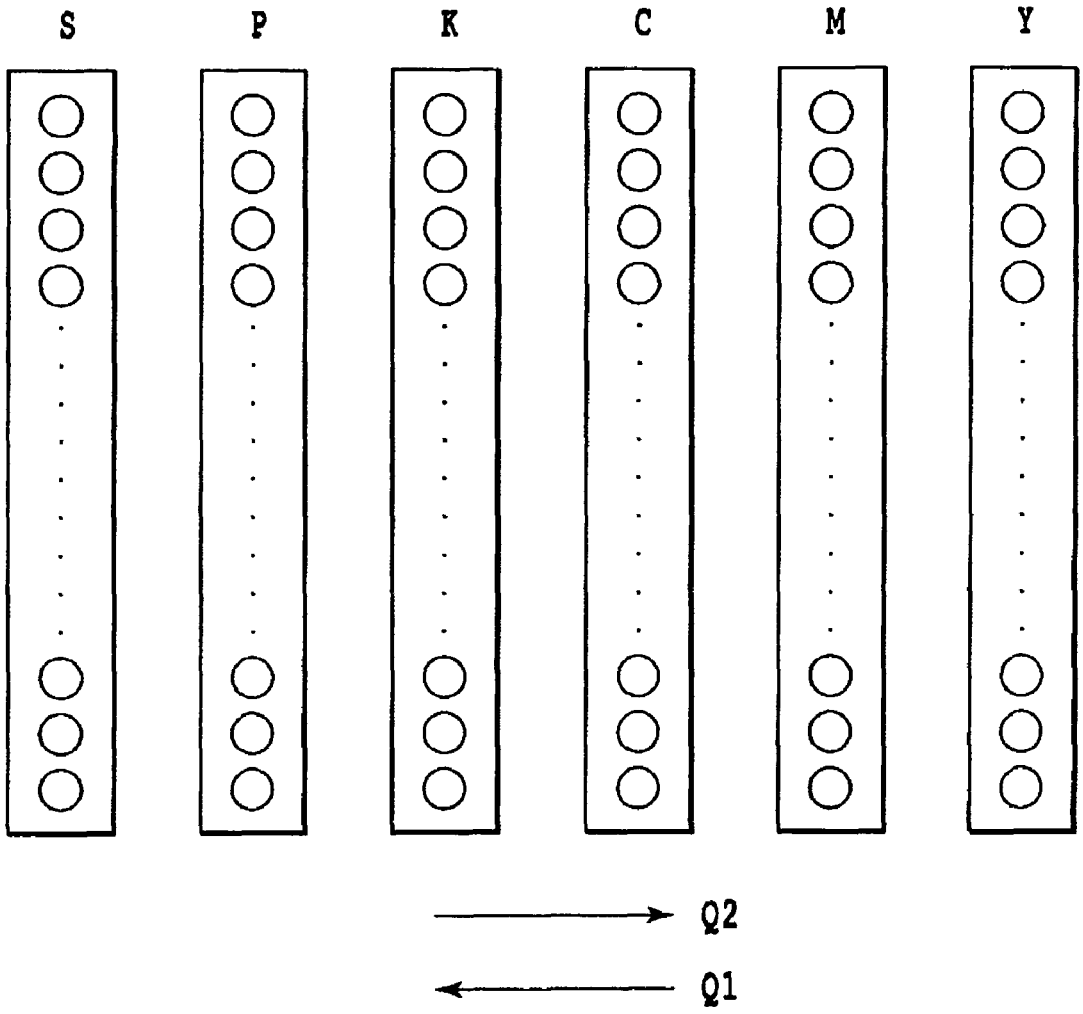
FIG. 18 illustrates an array of ink ejection nozzles of print heads used in a third embodiment of this invention.

In this embodiment, a print head as shown in FIG. 18 is used. That is, nozzle groups corresponding to the reaction liquid (S), coagulation inhibiting liquid (P), black ink (K), cyan ink (C), magenta ink (M) and yellow ink (Y) are arranged in the order shown in the direction of scan. The printing operation is executed according to a flow chart shown in FIG. 19.

Figure 19:
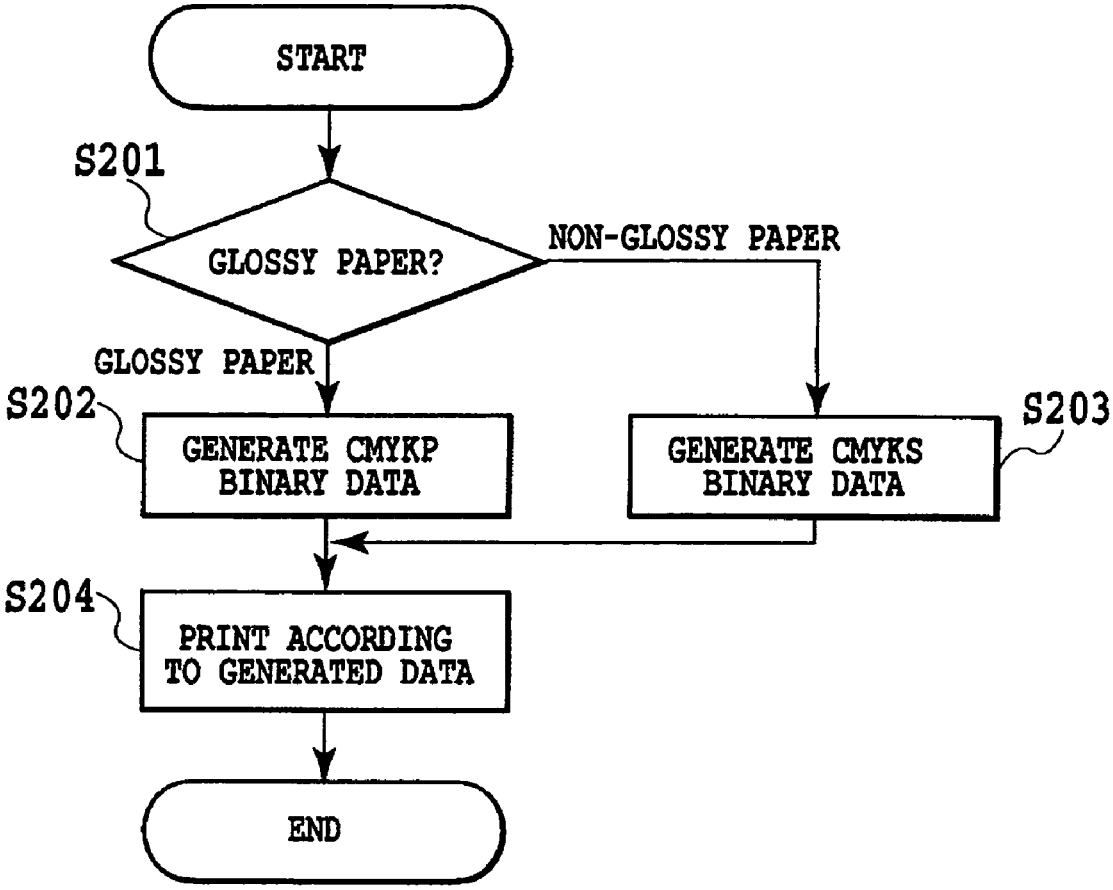
FIG. 19 is a flow chart showing a sequence of a printing operation in a third embodiment of this invention.

FIG. 19 is a flow chart showing the printing operation performed in this embodiment. First, in step S201 a determination is made of the kind of print medium used. This step S201 is similar to step S101 of FIG. 17, so its explanation is omitted here.

If step S201 decides that the print medium is glossy, such as glossy paper and glossy film, the processing moves to step S202. If the print medium is found to be a non-glossy medium, such as plain paper, high-quality paper and printable disk, the processing moves to step S203.

At step S202, to take advantage of the glossiness of the glossy medium, a coagulation inhibiting liquid (P) is used in addition to the coloring inks containing colorants during the printing operation. A reaction liquid is not used here. More specifically, when the printing apparatus receives CMYK multivalued data from the printer driver, it converts the CMYK multivalued data into CMYK binary data. Then, the CMYK binary data are logically ORed to generate binary data for ejecting the coagulation inhibiting liquid (P). Then, the processing proceeds to step S204 where it ejects the color inks and the coagulation inhibiting liquid from the print head onto the print medium according to the CMYKP binary data to form an image.

In step S203, on the other hand, to form a high density image by increasing the amount of colorant coagulates remaining on the surface of the print medium, a reaction liquid (S) is used in addition to the coloring ink containing colorant. Here, the coagulation inhibiting liquid is not used in printing. More specifically, when the printing apparatus receives CMYK multivalued data from the printer driver, it converts the CMYK multivalued data into CMYK binary data. Then, the CMYK binary data are logically ORed to generate binary data for ejecting the reaction liquid (S). Then, the processing proceeds to step S204 where it ejects the color inks and the reaction liquid from the print head onto the print medium according to the CMYKS binary data to form an image.

The reaction liquid may be applied to only a part of the locations where inks are to be applied. In this case, it is effective to partly thin the ejection data for the reaction liquid (S) generated as described above or make the dot diameters of the reaction liquid smaller than those of ink.

The means of applying the reaction liquid is not limited to the print head but it may be applied by a roller. In this case, the generation of the reaction liquid ejection data described above is not required. If the reaction liquid is applied by a roller, it is applied to the entire surface of the print medium.

With this embodiment, when an image is printed on a glossy print medium, the coagulation inhibiting liquid applied in addition to inks allows the inks to quickly soak into the print medium without coagulating on the surface. As a result, the formation of undulations on the surface of the print medium is minimized, maintaining the glossiness of the print medium. On the other hand, when an image is formed on a non-glossy print medium, the reaction liquid applied in addition to the inks reacts with the inks on the surface of the print medium. This allows a greater amount of colorant coagulates than those of the first to third embodiment to remain on the print medium surface, producing a high-density image.

Although the fourth embodiment does not use the reaction liquid and the coagulation inhibiting liquid at the same time when printing an image on the same print medium, they may also be used in combination. For example, it is possible to use the reaction liquid in those areas of the image that the user wants emphasized or spotlighted, such as important letters, and the coagulation inhibiting liquid in those areas that the user wants to make look attractive, such as pictures.

Other Embodiments

The above first to fourth embodiments have been described for the construction of the serial type ink jet printing apparatus in which nozzle groups for the coloring inks and the coagulation inhibiting liquid are arranged side by side in the main scan direction and eject their droplets in each printing scan. In a print area on the print medium, the printing scan, which consists of applying droplets of the coagulation inhibiting liquid first and then printing dots of coloring inks over the dots of the coagulation inhibiting liquid, is performed a plurality of times. On the print medium rather than serial type print head, the coagulation inhibiting liquid and the coloring inks are applied alternately. This invention, however, is not limited to this printing method. Further, in the serial type printing apparatus, forming an image in a two-way printing scan can also produce the intended effect of this invention. Even with a printing apparatus using a full-line type print head having nozzles arranged over the entire width of the print medium, this invention can be applied and its effect produced.

Further, although the first to fourth embodiments have been described to apply the coagulation inhibiting liquid from the print head, the application of the coagulation inhibiting liquid is not limited to this method. For example, it may be applied by a roller, in which case the generation of the coagulation inhibiting liquid ejection data is not required. When the coagulation inhibiting liquid is applied by the roller, the entire surface of the print medium is applied with the liquid.

With this invention, the coagulation of ink on the surface of the print medium can be prevented, assuring quick spreading and soaking of ink. This in turn keeps the surface of the print medium smooth even if an ink with a coagulating property is used to form an image on a glossy print medium. Therefore, a good image can be produced without impairing the glossiness of the print medium.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true sprit of the invention.

This application claims priority from Japanese Patent Application No. 2004-336366 filed Nov. 19, 2004, which is hereby incorporated by reference herein.

What is claimed is:

1. An ink jet printing method for printing an image on a print medium, said method comprising:

performing one printing mode selected from a plurality of printing modes including (i) a first printing mode for printing an image on a glossy paper by applying an ink containing a pigment and a coagulation inhibiting liquid for inhibiting a coagulation of the pigment contained in the ink without applying a reaction liquid for coagulating the pigment contained in the ink and (ii) a second printing mode for printing an image on a plain paper by applying the ink and the reaction liquid without applying the coagulation inhibiting liquid, wherein in the first printing mode, the coagulation inhibiting liquid is applied to at least a part of an area on the glossy paper where the ink is to be applied, and in the second printing mode, the reaction liquid is applied to at least a part of an area on the plain paper where the ink is to be applied.

2. An ink jet printing method for printing an image on a print medium, said method comprising:

a step of determining a kind of the print medium used for printing;

a step of, if it is determined that the print medium is a glossy paper, printing an image on the glossy paper by applying an ink containing a pigment and a coagulation inhibiting liquid for inhibiting a coagulation of the pigment contained in the ink without applying a reaction liquid for coagulating the pigment contained in the ink; and a step of, if it is determined that the print medium is plain paper, printing an image on the plain paper by applying the ink and the reaction liquid without applying the coagulation inhibiting liquid, wherein in the step of printing on the glossy paper, the coagulation inhibiting liquid is applied to at least a part of an area on the glossy paper where the ink is to be applied, and in the step of printing on the plain paper, the reaction liquid is applied to at least a part of the area on the second print medium plain paper where the ink is to be applied.

3. An ink jet printing apparatus comprising:

an ink ejecting head configured to eject an ink containing a pigment a first applying unit configured to apply a reaction liquid for accelerating a coagulation of the pigment contained in the ink; and a second applying unit configured to apply a coagulation inhibiting liquid for inhibiting a coagulation of the pigment caused by the ink and the reaction liquid; and a controller that performs one printing mode selected from a plurality of printing modes including (i) a first printing mode for printing an image on a glossy paper using the ink ejecting head and the first applying unit without using the second applying unit and (ii) a second printing mode for printing an image on a plain paper using the ink ejecting head and the second applying unit without using the first applying unit.

4. An ink jet printing apparatus according to claim 3, further comprising a first generating unit configured to generate data for applying the coagulation inhibiting liquid based on data for ejecting the ink and a second generating unit configured to generate data for applying the reaction liquid based on data for ejecting the ink.

5. An ink jet printing apparatus according to claim 3, wherein the coagulation inhibiting liquid contains a nonionic surfactant with five or more ethylene oxide groups.

6. An ink jet printing apparatus according to claim 3, wherein the coagulation inhibiting liquid contains a component for inhibiting the coagulation of the pigment by preventing contact among the pigment, due to an effect of steric hindrance.

* * * * *